US010477979B2

(12) United States Patent
Jewett et al.

(10) Patent No.: US 10,477,979 B2
(45) **Date of Patent: *Nov. 19, 2019**

(54) POCKETED SPRING ASSEMBLY

(71) Applicant: L&P Property Management Company, South Gate, CA (US)

(72) Inventors: Jason Jewett, Carthage, MO (US); Darrell A. Richmond, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 250 days.

This patent is subject to a terminal disclaimer.

(21) Appl. No.: 15/447,717

(22) Filed: Mar. 2, 2017

(65) Prior Publication Data

US 2018/0049559 A1 Feb. 22, 2018

Related U.S. Application Data

(60) Provisional application No. 62/377,074, filed on Aug. 19, 2016.

(51) Int. Cl.
*A47C 27/06* (2006.01)
*A47C 27/05* (2006.01)

(52) U.S. Cl.
CPC ..... *A47C 27/064* (2013.01); *A47C 27/05* (2013.01)

(58) Field of Classification Search
CPC ..... A47C 27/05; A47C 27/06; A47C 27/061; A47C 27/062; A47C 27/063; A47C 27/064; A47C 27/065; A47C 27/066; A47C 27/067; A47C 27/068; A47C 27/07
See application file for complete search history.

(56) References Cited

U.S. PATENT DOCUMENTS 3,916,464 A * 11/1975 Tyhanic ..... A47C 23/043 267/91
4,234,983 A * 11/1980 Stumpf ..... A47C 27/064 5/246
5,868,383 A * 2/1999 Codos ..... B68G 9/00 267/166.1
5,924,681 A * 7/1999 Bullard ..... A47C 27/063 267/89
6,256,820 B1 * 7/2001 Moser ..... A47C 27/062 267/166
6,272,706 B1 8/2001 McCune et al.
6,295,676 B1 * 10/2001 Warner ..... A47C 20/04 5/716

(Continued)

*Primary Examiner* — Nicholas F Polito
*Assistant Examiner* — Myles A Throop
(74) *Attorney, Agent, or Firm* — Wood, Herron & Evans, LLP

(57) ABSTRACT

A pocketed spring assembly comprises a plurality of parallel strings of springs, each string joined to at least one adjacent string, each string comprising first and second opposed plies of fabric and a plurality of pockets formed along a length of the string by transverse seams joining the first and second plies. At least one spring is positioned in each pocket. Exterior strings have identical springs in their pockets. Interior strings have two different springs along their length, the outermost springs being firmer than the interior core springs. The pocketed spring assembly has increased firmness or edge support along all four sides due to the different coil springs of the assembly.

32 Claims, 20 Drawing Sheets

(56) References Cited

U.S. PATENT DOCUMENTS

| | | | | |
|---|---|---|---|---|
| 7,426,810 | B2 * | 9/2008 | Takahashi | A47C 23/0433 53/114 |
| 7,979,935 | B2 * | 7/2011 | Grothaus | A47C 27/064 267/93 |
| 10,206,515 | B1 * | 2/2019 | Jewett | A47C 27/001 |
| 2004/0103479 | A1 | 6/2004 | Mossbeck et al. | |
| 2004/0128773 | A1 * | 7/2004 | Barber | A47C 27/062 5/716 |
| 2015/0359349 | A1 | 12/2015 | Eigenmann et al. | |
| 2016/0045034 | A1 | 2/2016 | Hager et al. | |
| 2016/0166076 | A1 | 6/2016 | Mossbeck | |

* cited by examiner

POCKETED SPRING ASSEMBLY

CROSS REFERENCE TO RELATED APPLICATIONS

This application claims the priority of U.S. Provisional Patent Application Ser. No. 62/377,074, which is fully incorporated by reference herein.

FIELD OF THE INVENTION

This invention relates generally to bedding and seating products and, more particularly, to pocketed spring assemblies used in bedding and seating products.

BACKGROUND OF THE INVENTION

Mattress spring core construction over the years has been a continuously improving art with advancements in materials and machine technology. A well known form of spring core construction is known as a Marshall spring construction wherein metal coil springs are encapsulated in individual pockets of fabric and formed as elongate or continuous strings of pocketed coil springs. In an earlier form, these strings of coil springs were manufactured by folding an elongate piece of fabric in half lengthwise to form two plies of fabric and stitching transverse and longitudinal seams to join the plies of fabric to define pockets within which the springs were enveloped.

More recently, improvements in spring core constructions have involved the use of fabrics, which are thermally or ultrasonically weldable to themselves. By using such welding techniques, these fabrics have been advantageously used to create strings of individually pocketed coil springs wherein transverse and longitudinal welds, instead of stitching, are used to form the pockets encapsulating the springs.

Once strings of pocketed springs are constructed, they may be assembled to form a spring core construction for a mattress, cushion or the like by a variety of methods. For example, multiple or continuous strings may be arranged in a row pattern corresponding to the desired size and shape of a mattress or the like, and adjacent rows of strings may be interconnected by a variety of methods. The result is a unitary assembly of pocketed coil springs serving as a complete spring core assembly.

Often a pocketed spring assembly is surrounded with a border made of foam or any other suitable material to provide edge support around the perimeter of the pocketed spring assembly. Such a pocketed spring assembly is mounted upon a base and is completely enclosed within an upholstered covering material. The base and border are known in the industry as a "bucket" into which a pocketed spring assembly may be inserted before the "bucket" is covered with one or more padding or cushioning layers. Upon receiving multiple pocketed spring assemblies, a mattress manufacturer must insert each of the pocketed spring assembly inside a bucket specifically constructed to receive a specified size of pocketed spring assembly. The mattress manufacturer has to construct the foam encasements or "buckets" of different sizes via separate processes, which have proven to be costly due to the labor cost required. Mattress manufacturers would prefer to eliminate the process of building foam encasements or "buckets" and instead receive a pocketed spring assembly within built-in edge support along all four sides of the pocketed spring assembly. It is generally known within the bedding industry that edge supports made of pocketed springs are more durable than foam edge supports.

Therefore, there is a need to provide a pocketed spring assembly having four sides of edge support which may be easily and quickly roll packed for shipping.

There further is a need for a pocketed spring assembly having four sides of edge support without using a bucket, which may be shipped in bulk in a cost effective manner.

There is further a need for a pocketed spring assembly, which when received by a mattress manufacturer, does not require additional edge support to be added, thereby reducing the cost of manufacturing a finished mattress having edge support.

SUMMARY OF THE INVENTION

According to one aspect of the present invention, a bedding or seating product having four sides of edge support or perimeter edge support is provided. The product comprises a pocketed spring assembly comprising a plurality of parallel strings of springs including exterior strings and interior strings of approximately the same height. Each string is joined to at least one adjacent string in any known manner. In addition, each string may be joined to upper and lower scrim sheets. Each string comprises first and second opposed plies of fabric and a plurality of pockets formed along the length of the string by transverse or separating seams joining the first and second plies. At least one spring is positioned in each pocket. Each of the springs has upper and lower end turns and a plurality of central convolutions between the end turns, at least one of the central convolutions having a barrel diameter greater than the diameters of the other convolutions of the spring. Such a spring is known in the industry as a barrel-shaped coil spring. Cushioning materials may be placed on one or both sides of the pocketed spring assembly, and a covering may encase the pocketed spring assembly and cushioning materials.

Each of the pockets of each exterior string contains an edge spring having a first out-of-pocket barrel diameter and a first out-of-pocket height. Each of the edge springs is identical and has out-of-pocket characteristics different than the core springs described below.

Each of the interior strings comprises outer pockets and inner pockets between the outer pockets. Each of the inner pockets contains a core spring. Each core spring is identical and has a second out-of-pocket barrel diameter greater than the first out-of-pocket barrel diameter of the edge springs. Each core spring further has a second out-of-pocket height less than the first out-of-pocket height of the edge springs. Each of the outer pockets contains an edge spring. Due to the core and edge springs having approximately the same in-pocket height, the pocketed spring assembly has four sides of edge support, the pocketed edge springs surrounding the pocketed core springs.

In any of the embodiments, the strings of springs may extend longitudinally or transversely. A bedding or seating product may be posturized into regions or zones of different firmness by incorporating different strings of springs into the product. In the embodiments described herein, each of the pocketed spring assemblies has a firmer perimeter than the interior core of the assembly due to different springs being located in the pockets of the strings making the pocketed spring assembly.

In each of the embodiments, each of the exterior strings has the same spring in each pocket of the string. On the other hand, in each embodiment, each of the interior strings has inner pockets having at least one spring and outer pockets having at least one different spring. In each of the interior strings, the springs of the outer pockets may vary in barrel diameter, out-of-pocket height or wire gauge, or any combination thereof, from the springs of the inner pockets of the interior string.

In another aspect, a pocketed spring assembly for a bedding or seating product is provided. The pocketed spring assembly comprises interior and exterior parallel strings of springs of the same height. Each string is joined to at least one adjacent string. Each of the strings comprises a plurality of interconnected pockets. Each of the pockets contains at least one spring or other resilient member encased in fabric. The fabric is joined to itself along a longitudinal seam and has first and second opposed plies of fabric on opposite sides of the springs. The fabric of the first and second plies is joined by transverse seams. Each of the springs has upper and lower end turns and a plurality of central convolutions between the end turns. The spring has two end portions and a middle portion between the end portions. The middle portion has a barrel diameter, which is the largest diameter of the spring. The convolutions of the middle portion are greater in diameter than the convolutions of the end portions of the spring.

In the second embodiment of pocketed spring assembly having four sides of edge support, each of the pockets of each of the exterior strings contains a heavy edge spring. Each interior string contains a plurality of core springs contained in inner pockets and edge springs in outer pockets of the interior string. The heavy edge and edge springs have the same out-of-pocket height and same barrel diameter. The core springs have a greater barrel diameter and a smaller out-of-pocket height than the edge and heavy edge springs. The pocketed spring assembly has four sides of edge support, the edge and heavy edge springs surrounding the core springs.

In another aspect, a pocketed spring assembly for a bedding or seating product is provided. The pocketed spring assembly comprises interior and exterior parallel strings of springs. Each string is joined to at least one adjacent string. Each of the strings comprises a plurality of interconnected pockets. Each of the pockets contains at least one spring or other resilient member encased in fabric. The fabric is joined to itself along a longitudinal seam and has first and second opposed plies of fabric on opposite sides of the springs. The fabric of the first and second plies is joined by transverse seams. Each of the springs has upper and lower end turns and a plurality of central convolutions between the end turns. The spring has a middle portion having a barrel diameter between end portions. The convolutions of the middle portion are greater in diameter than the convolutions of the end portions of the spring.

Each of the pockets of each of the exterior strings contains a post spring. Each interior string contains a plurality of core springs contained in inner pockets and edge springs in outer pockets of the interior string. The core springs have a barrel diameter greater than the edge springs. The edge springs have a greater diameter than the post springs. The post springs have more convolutions than the core and edge springs. The core and edge springs may or may not have the same number of convolutions.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE INVENTION

Figure 1:
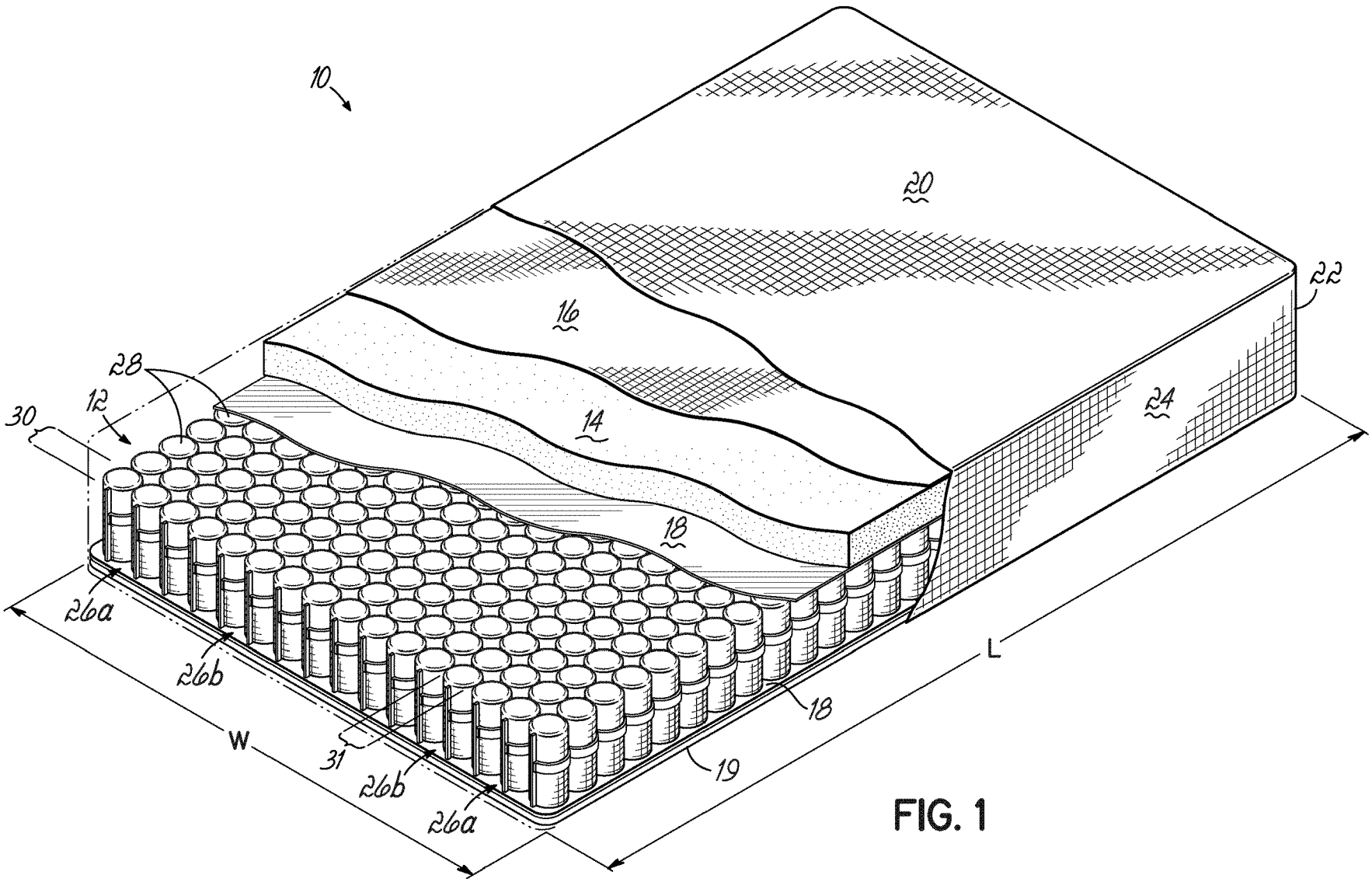
FIG. 1 is a perspective view, partially broken away, of a bedding or seating product incorporating one embodiment of pocketed spring assembly.

Referring first to FIG. 1, there is illustrated a bedding product in the form of a single-sided mattress 10 incorporating the principles of the present invention. This product or mattress 10 comprises a pocketed spring assembly 12 over the top of which there lay conventional padding or cushioning layers 14, 16 which may be foam, fiber, gel, a pocketed spring blanket or any other suitable materials or any combination thereof. Although two cushioning layers 14, 16 are shown, any number of cushioning layers may be incorporated into the product.

The pocketed spring assembly 12 may include upper and lower scrim sheets 18 attached with adhesive to upper and lower surfaces of the strings of springs 26 of the pocketed spring assembly 12. The lower scrim sheet 18 may be adhesively secured to a base 19 which may be made of foam, fiber or any other desired material. The pocketed spring assembly 12 and base 19 may be completely enclosed within an upholstered covering material 20. In any of the embodiments shown or described herein, one or both of the scrim sheets may be omitted.

As shown in FIG. 1, fully assembled, the product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

As shown in FIG. 1, pocketed spring assembly 12 is manufactured from multiple strings 26*a*, 26*b* of pocketed springs 28 joined together. Each string of pocketed springs 26*a*, 26*b* extends longitudinally or from head-to-foot along the full length of the product 10.

Figure 1A:
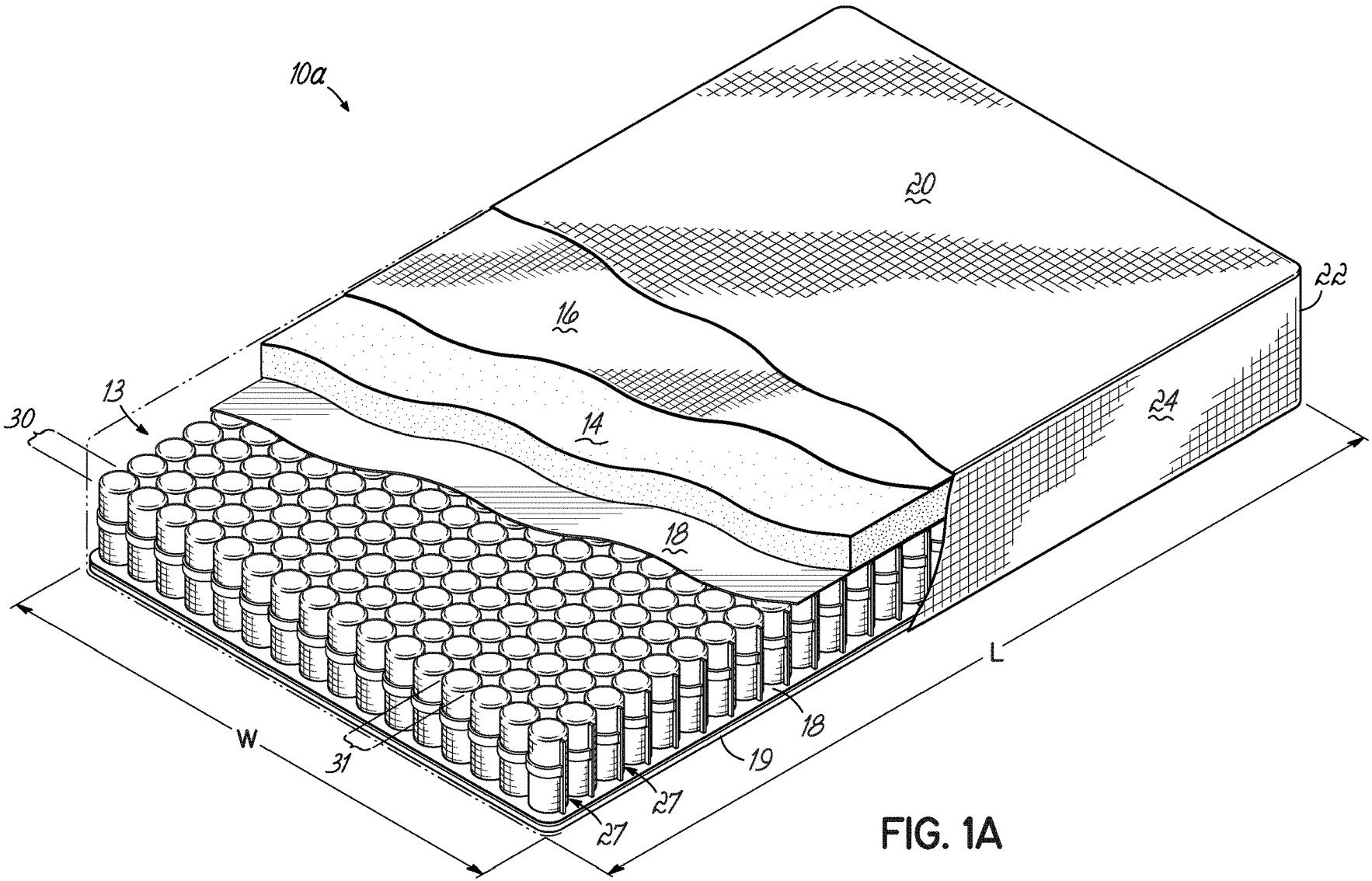
FIG. 1A is a perspective view, partially broken away, of a bedding or seating product incorporating another pocketed spring assembly.

Although the strings are illustrated as extending longitudinally or from head-to-foot in the pocketed spring assembly 12 of FIG. 1, they may extend transversely or from side-to-side as shown in the pocketed spring assembly 13 shown in the product 10*a* shown in FIG. 1A. The pocketed spring assembly 13 comprises multiple transversely extending strings 27 of pocketed springs.

Figure 1B:
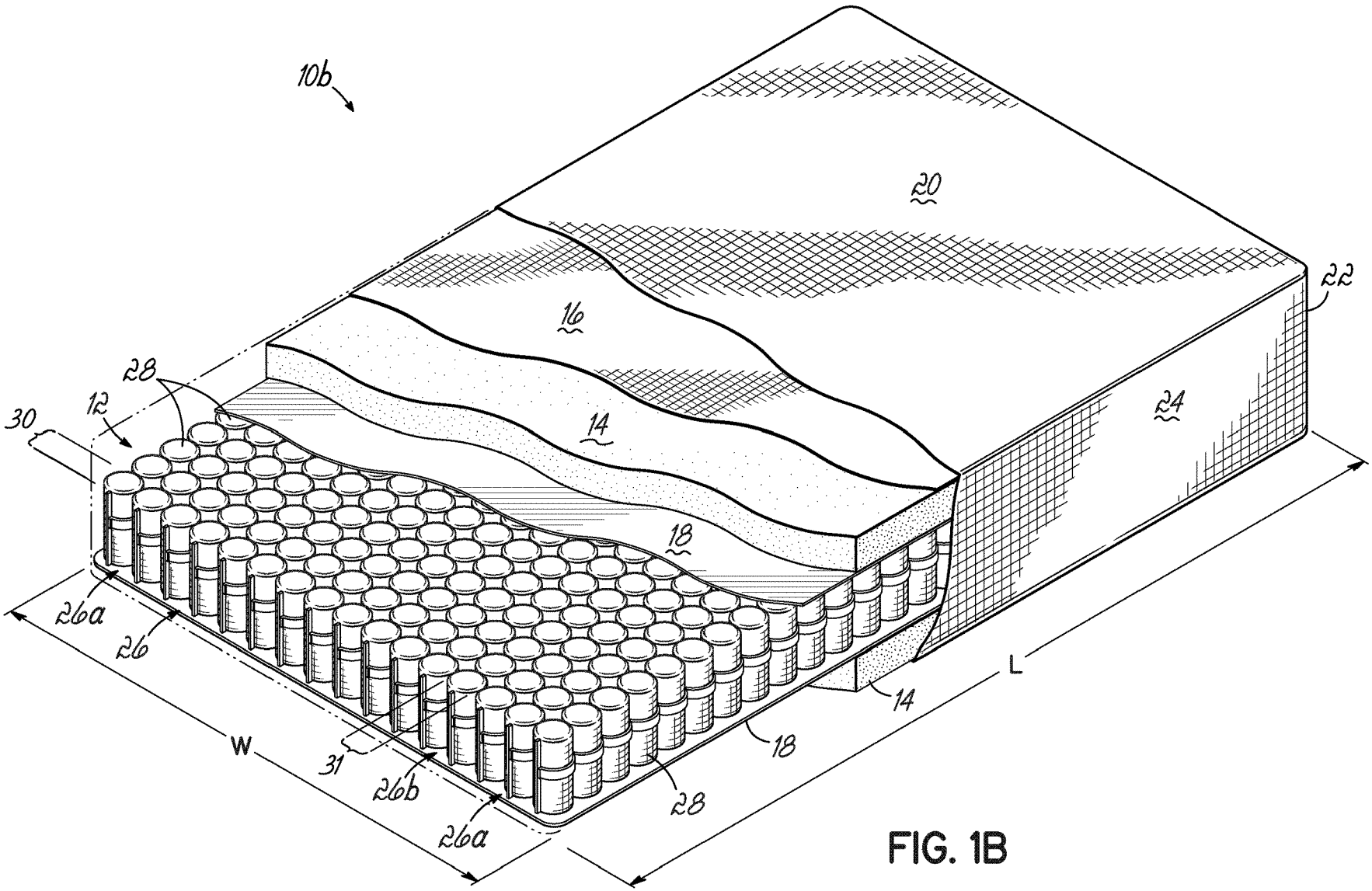
FIG. 1B is a perspective view, partially broken away, of a double-sided bedding product incorporating the pocketed spring assembly of FIG. 1.

FIG. 1B illustrates a double-sided mattress or product 10*b* comprising a pocketed spring assembly 12 and scrim sheets 18 identical to those shown in the mattress 10 of FIG. 1. However, the mattress 10*b* of FIG. 1B has conventional padding layers 14, 16 above and below the pocketed spring assembly 12. Although two cushioning layers 14, 16 are shown per side, any number of cushioning layers may be incorporated into the product on either side.

The pocketed spring assembly 12 comprises a plurality of strings 26*a*, 26*b* of pocketed springs extending from head-to-foot or longitudinally. The pocketed spring assembly 13 comprises a plurality of strings 27 of pocketed springs extending from side-to-side or transversely. Due to the symmetric nature of the springs inside the strings of springs, any embodiment of pocketed spring assembly shown or described herein may be used in a single-sided and/or a double-sided product.

According to the practice of this invention, any of the padding or cushioning layers may be omitted in any of the embodiments shown or described herein. The novel features reside in the pocketed spring assembly.

These strings of pocketed springs and any other strings of springs described or shown herein, may be connected in side-by-side relationship as, for example, by gluing the sides of the strings together in an assembly machine, so as to create an assembly or matrix of springs having multiple rows and columns of pocketed springs bound together as by gluing, welding or any other conventional assembly process commonly used to create pocketed spring cores or assemblies. Referring to FIGS. 1 and 1B, the longitudinally extending strings 26*a* and 26*b* of pocketed springs 28 may be joined so that the individually pocketed springs are aligned in transversely extending rows 30 and longitudinally extending columns 31. The same is true with transversely extending strings 27 shown in FIG. 1A.

Figure 2:
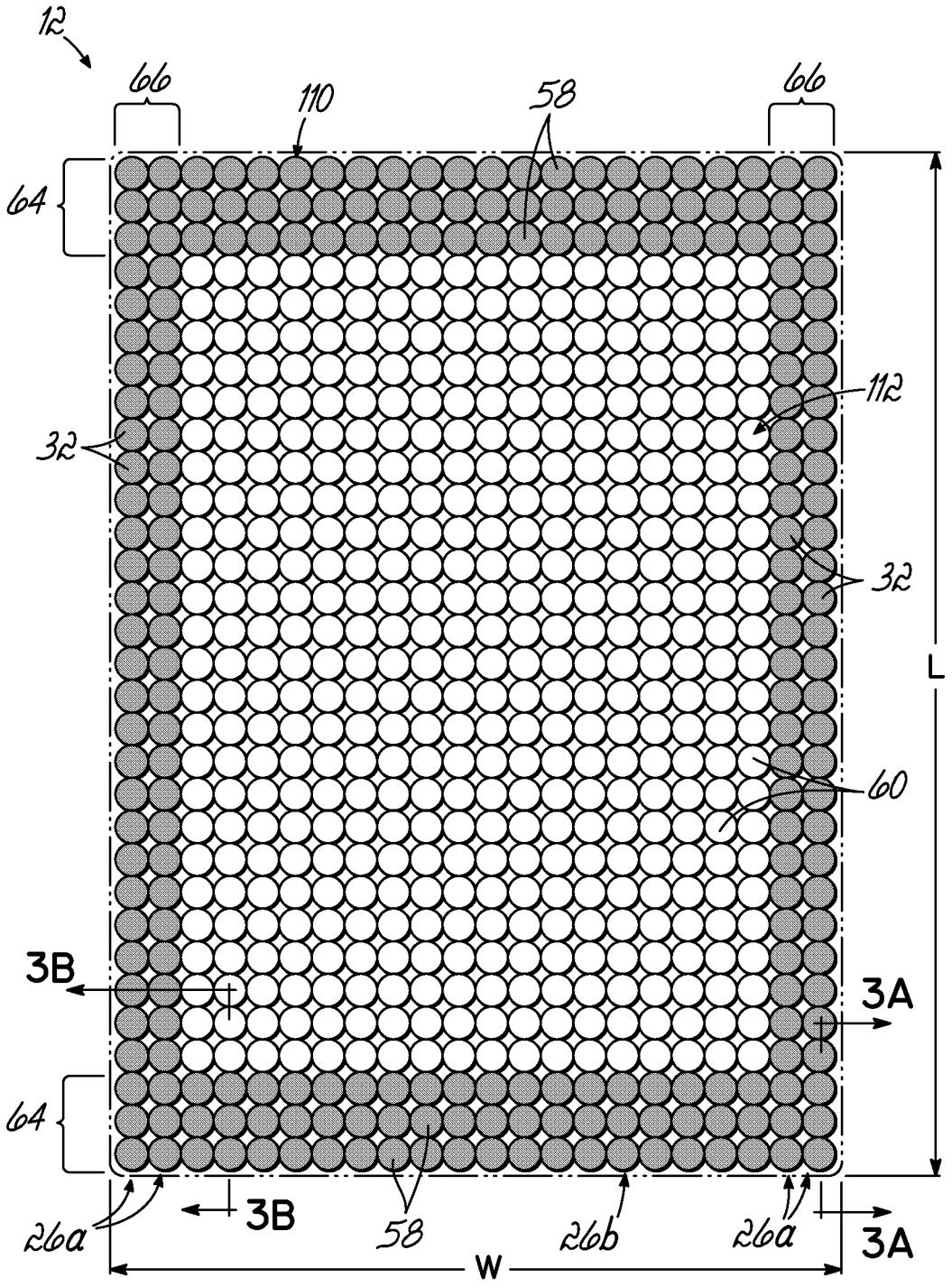
FIG. 2 is a top view of the pocketed spring assembly of FIG. 1.
Figure 3:
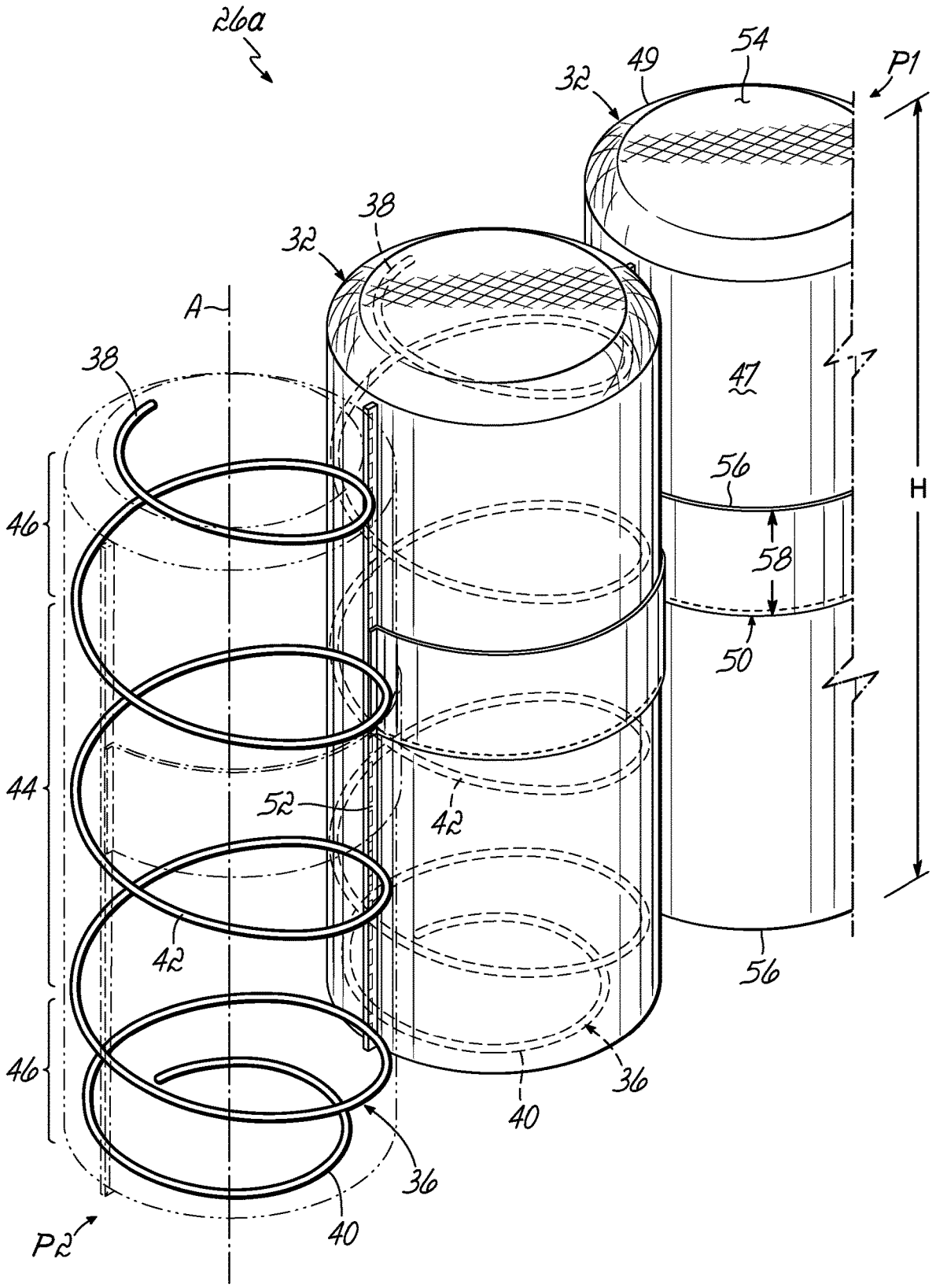
FIG. 3 is a perspective view of a portion of one of the exterior strings of FIG. 2.
Figure 3A:
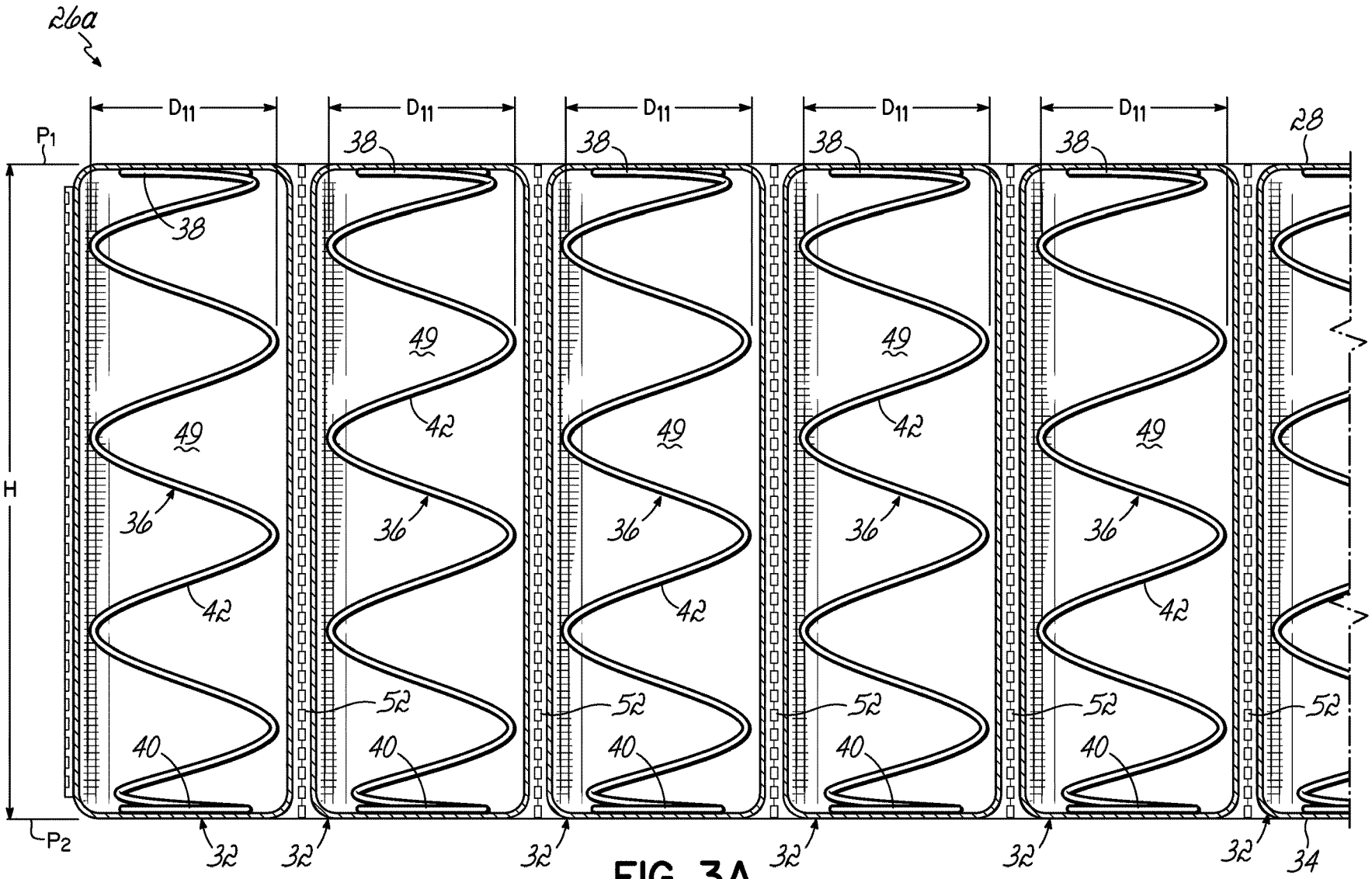
FIG. 3A is a cross-sectional view taken along the line 3A-3A of FIG. 2 showing an outer portion of one of the exterior strings.

FIGS. 2, 3, 3A and 3B show one embodiment of pocketed spring assembly 12 which comprises two different longitudinally extending strings of springs: exterior strings of springs 26*a* and interior strings of springs 26*b*. As shown in FIGS. 3 and 3A, each of the strings 26*a*, 26*b* of pocketed spring assembly 12 is the same height "H". As shown in FIG. 2, pocketed spring assembly 12 comprises two exterior longitudinally extending strings of springs 26*a* on each side of multiple interior strings of springs 26*b*. The number of interior strings of springs 26*b* depends on the size of the product 10. Each exterior string 26*a* and each interior string 26*b*, respectively, extends the entire length "L" of the mattress or product in which it is used. As shown in FIG. 2, each set of two exterior strings 26*a* comprises a side section 66 of pocketed spring assembly 12. In some applications, each side section of the pocketed spring assembly may comprise more or less than two strings of springs per side section. In other words, the number of exterior strings of springs 26*a* may vary depending on the size of the product or other factors, such as the desired amount of side edge support.

Figure 11:
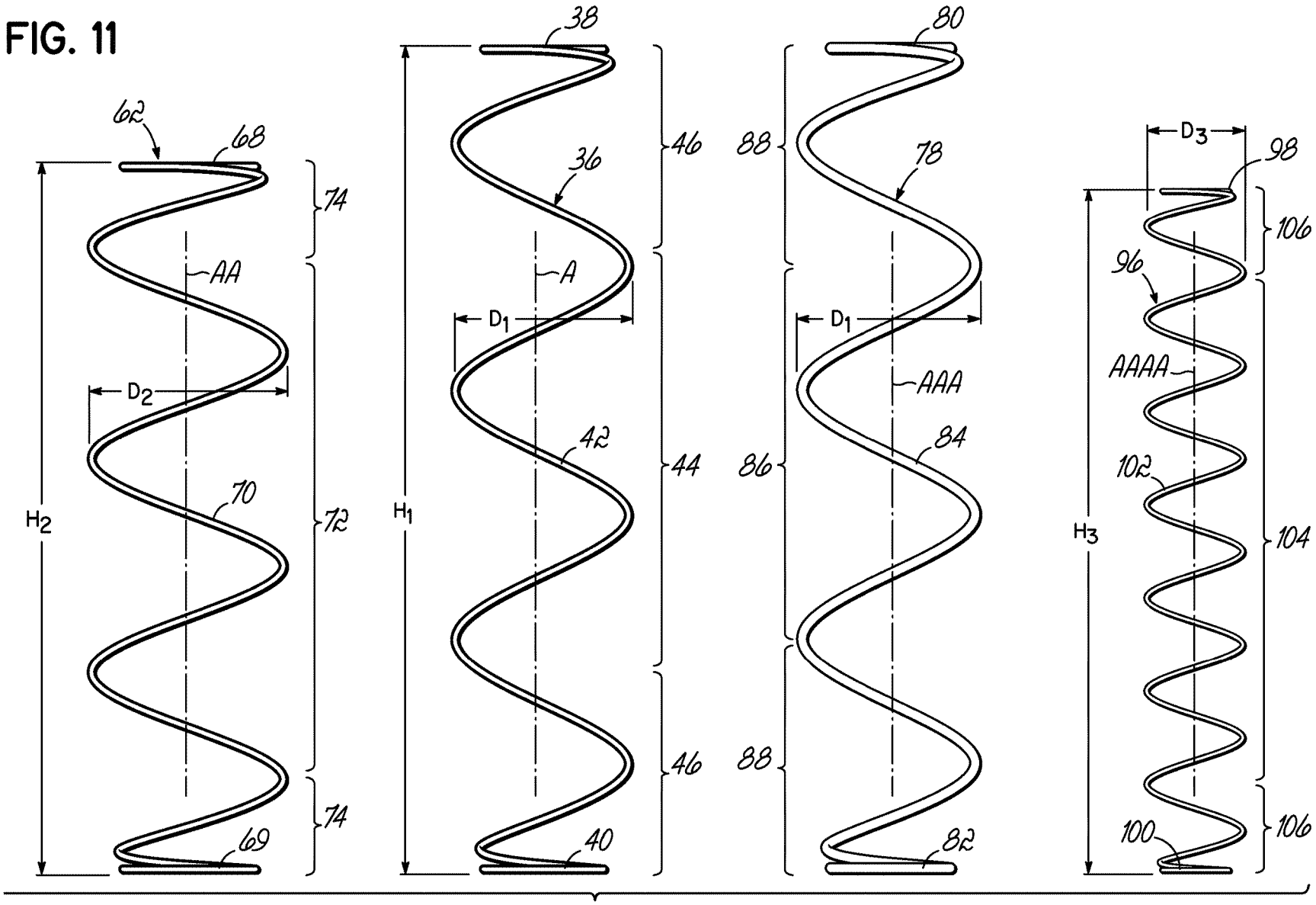
FIG. 11 is a side elevational view, moving left to right, of a core spring, an edge spring, a heavy edge spring and a post spring.

As shown in FIG. 3A, each exterior string 26*a* comprises a row of interconnected fabric pockets 32. Each of the fabric pockets 32 contains at least one edge coil spring 36. Each edge coil spring 36 is shown in an out-of-pocketed condition in FIG. 11 and shown in an in-pocket condition compressed to a height "H" within one of the pockets 32 in FIGS. 3 and 3A. As best shown in FIG. 3, each edge spring 36 has a central or longitudinal axis A, an upper end turn 38, a lower end turn 40 and a plurality of central convolutions 42 between the end turns. FIGS. 3 and 3A illustrate a barrel-shaped edge spring 36 in which the diameter of the end turns 38, 40 is less than the diameter of the central convolutions 42. As shown in FIG. 11, at least one of the central convolutions 42 has an out-of-pocket barrel diameter $D_1$ greater than the out-of-pocket diameters of the other convolutions of the edge spring 36. As best shown in FIG. 3, each barrel-shaped edge spring 36 is symmetrical, having a center or middle portion 44 and two identical end portions 46. Upon being compressed and inserted into one of the pockets 32, the barrel diameter $D_1$ of edge spring 36 shown in FIG. 11 expands or increases to barrel diameter $D_{11}$ shown in FIGS. 3A and 3B.

Preferably, one piece of fabric is used to create each exterior string 26*a*, the piece of fabric being folded over onto itself around the edge coil springs 36. As best shown in FIG. 3, opposite sides or plies 47, 49 of the fabric are sewn, welded or otherwise secured together in order to create a longitudinal seam 50 and a plurality of separating or transverse seams 52. FIG. 3 illustrates ply 47 being closest to the reader and ply 49 being behind the springs 36 or away from the reader.

Although the seams or welds in all of the embodiments shown herein are shown as being heat-welded spaced rectangles, any of the seams may be spaced dots, triangles or solid line segments without spaces.

As best shown in FIG. 3, opposed edges 56 of the piece of fabric used to create the exterior strings 26*a* are aligned and spaced from the longitudinal seam 50 a distance indicated by numeral 58. Although the drawings indicated the longitudinal seam 50 being below the free edges 56 of the piece of fabric, the longitudinal seam 50 may be above the free edges 56 of the piece of fabric.

As shown in FIGS. 3 and 3A, the exterior string 26*a* has a generally planar top surface 54 in a top plane P1 and a parallel generally planar bottom surface 56 in a bottom plane P2. The linear distance between the top and bottom surfaces 54, 56 of the exterior string 26*a* defines a height H of the string 26*a*. This linear distance further defines the height H of the pocketed spring assembly 12 because each of the exterior strings 26*a* and interior strings 26*b* has approximately the same height.

Figure 12A:
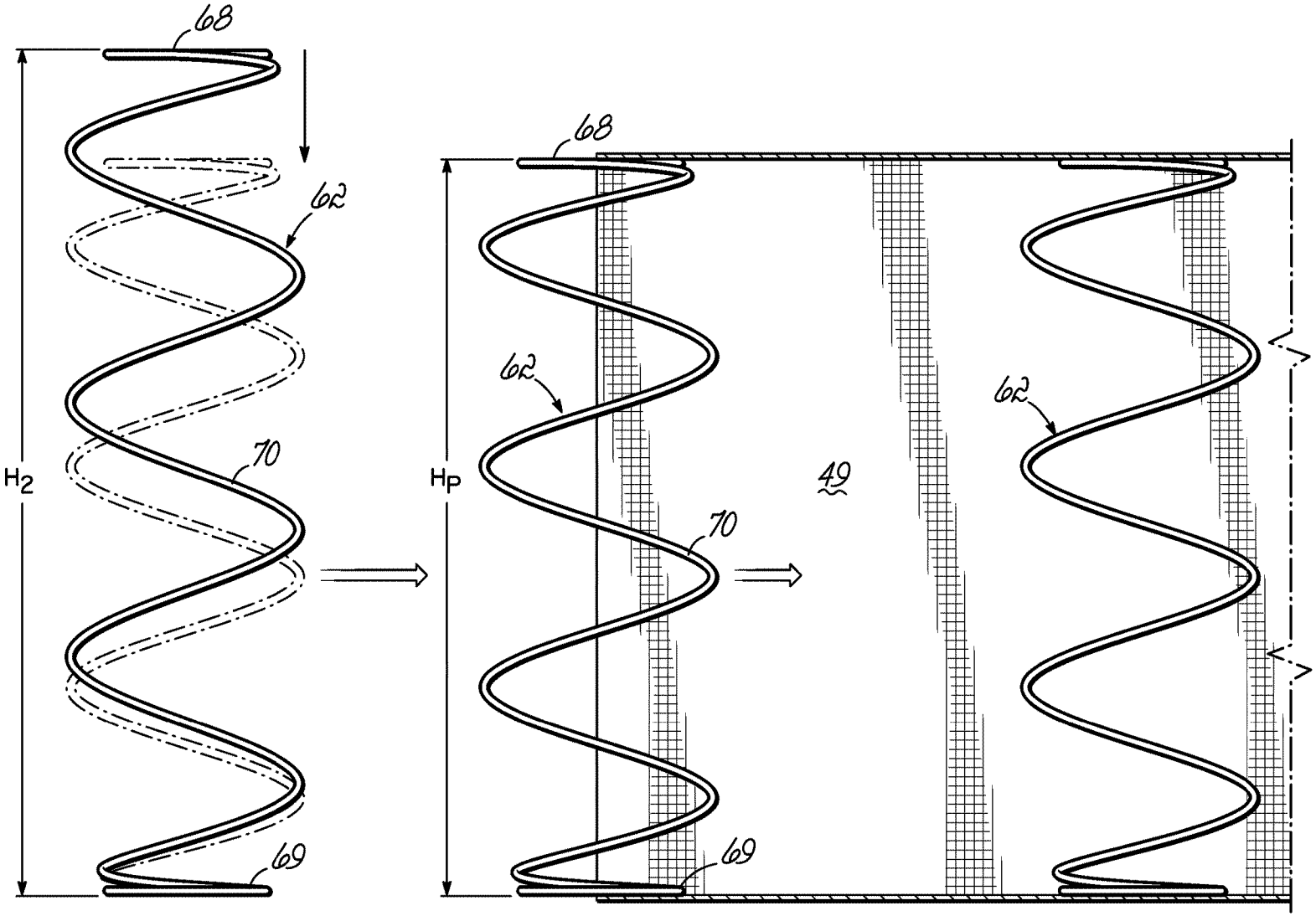
FIG. 12A is a side elevational view of a core spring being compressed and pocketed.
Figure 12B:
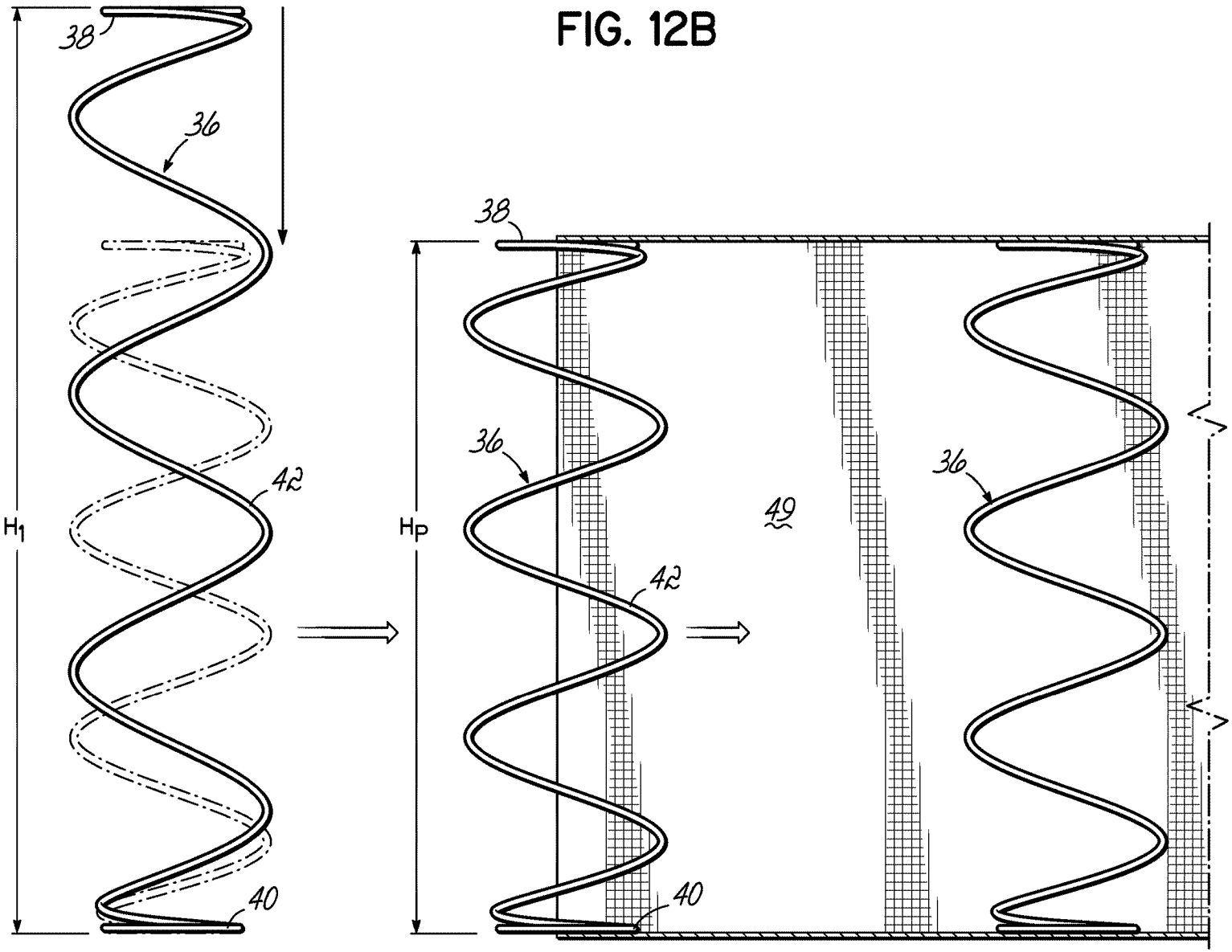
FIG. 12B is a side elevational view of an edge spring being compressed and pocketed.

As shown in FIG. 11, each of the edge springs 36 has an out-of-pocket height "$H_1$". As shown in FIG. 12B, when compressed and inserted into a pocket 32 of an exterior string 26*a* or an outer pocket 58 of an interior string 26*b*, the height of the edge spring 36 shortens from "$H_1$" to "$H_p$".

Referring back to FIG. 2, each interior string 26*b* of pocketed spring assembly 12 comprises a row of interconnected fabric pockets 58, 60 of the same height. Three fabric pockets 58 are located at each end of each of the interior strings 26*b* with fabric pockets 60 therebetween. For purposes of this document, the outermost pockets 58 are considered outer pockets of the interior string 26*b*, and the pockets 60 therebetween are considered inner pockets of the interior string 26*b*. Within each interior string 26*b*, each outer pocket 58 contains at least one edge spring 36, and each inner pocket 60 contains at least one core spring 62. Although the drawings show each interior string 26*b* of pocketed spring assembly 12 having three outer pockets 58 at each end, it is within the scope of the present invention that each interior string 26*b* may have one, two or any number of outer pockets 60 at each end of the interior string 26*b*.

As shown in FIG. 2, pocketed spring assembly 12 has opposite end sections 64 made up of solely pocketed edge springs 36. The end sections 64 and side sections 66, each containing pocketed edge springs 36, make up a picture-frame shape of edge support which provides increased stiffness around the perimeter of the pocketed spring assembly 12.

In this embodiment, the pocketed spring assembly 12 has a four-sided perimeter section 110 surrounding an interior or core section 112. The perimeter section 110 of pocketed spring assembly 12 comprises pocketed edge springs 36. The core section 112 comprises pocketed core springs 62. The pocketed spring assembly 12 has a uniform height H. Each side of the perimeter section 110 is firmer than the core section 112 due to the out-of-pocket characteristics of the two different springs (edge and core springs) in the two different sections: perimeter section 110 and core section 112. See FIG. 2.

Figure 3B:
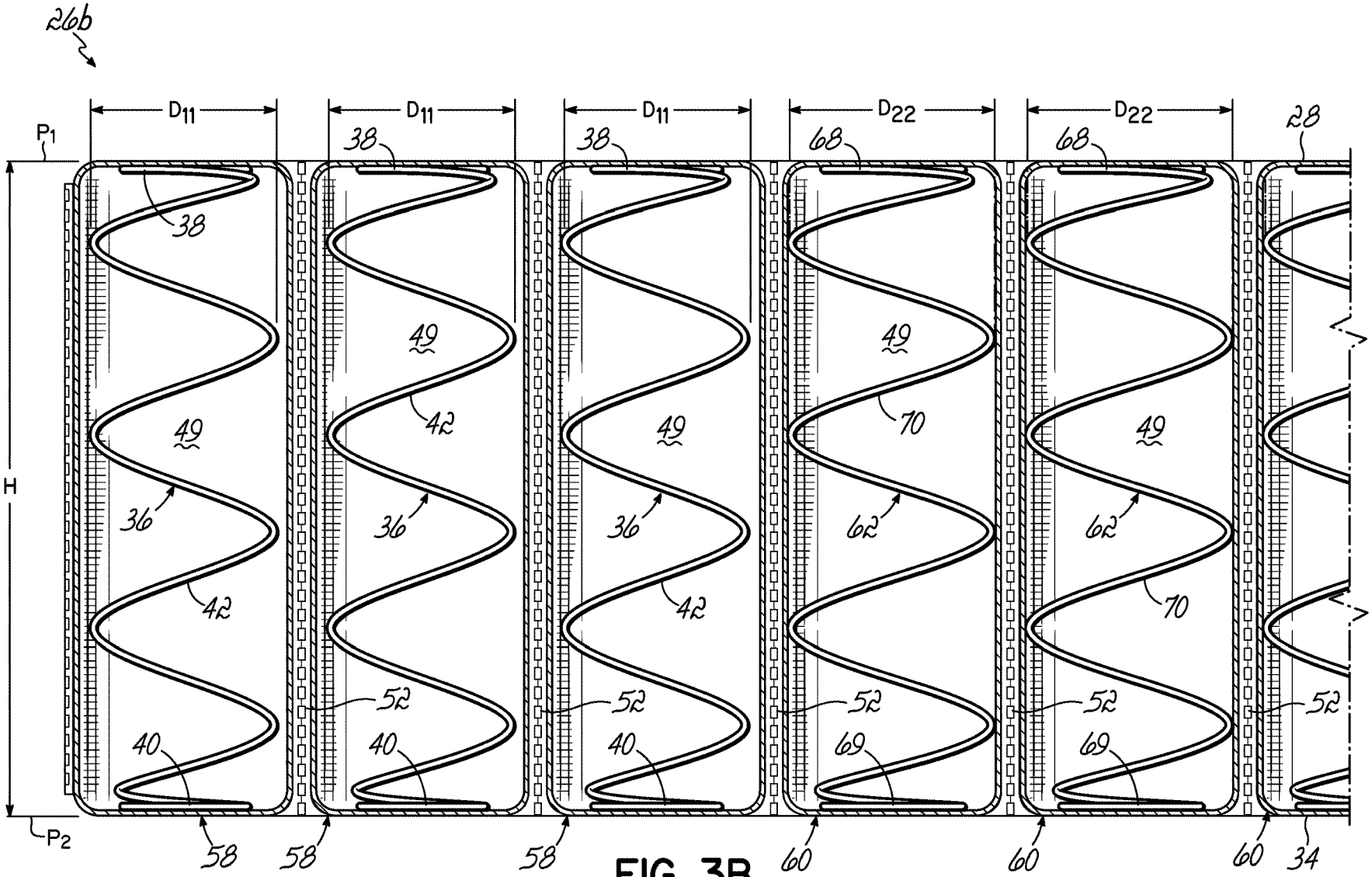
FIG. 3B is a cross-sectional view taken along the line 3B-3B of FIG. 2 showing an outer portion of one of the interior strings.

As shown in FIG. 3B, each of the core springs 62 contained in inner pockets 60 of the interior string 26*b* is shown in an out-of-pocket or relaxed condition in FIG. 11. Each core spring 62 is generally barrel-shaped, like edge springs 36 described above, but shorter than edge springs 62. As best shown in FIG. 11, each core spring 62 has a central or longitudinal axis AA, an upper end turn 68, a lower end turn 69 and a plurality of central convolutions 70 between the end turns. FIG. 11 illustrates a barrel-shaped core coil spring 62 in which the diameter of the end turns 68, 69 is less than the diameter of the central convolutions 70. As best shown in FIG. 11, at least one of the central convolutions 70 has an out-of-pocket barrel diameter $D_2$ greater than the diameters of the other convolutions of the core spring 62. As best shown in FIG. 11, each barrel-shaped core spring 62 is symmetrical, having a center or middle portion 72 and two identical end portions 74. Upon being compressed and inserted into one of the inner pockets 60, the barrel diameter $D_2$ of core spring 62 shown in FIG. 11 expands as shown in FIG. 12A. As shown in FIG. 12A, when compressed and inserted into an inner pocket 60 of an interior string 26*b*, the height of the core coil spring 62 shortens to "$H_p$".

In some embodiments, each of the edge springs 36 within each of the exterior strings 26*a* of pocketed spring assembly 12 is made of the same gauge wire. In some embodiments, each of the core and edge springs 62, 36, respectively, within each of the interior strings 26*b* of pocketed spring assembly 12, is made of the same gauge wire. Thus, all the pocketed springs of the pocketed spring assembly 12 may be made of the same gauge wire. In one embodiment, all the springs may be made of 14 gauge wire; in another embodiment, each of the springs may be made of 13.75 gauge wire.

As shown in FIG. 11, in a relaxed or out-of-pocket condition, each of the core springs 62 has a lesser out-of-pocket height, i.e., is shorter than the out-of-pocket height $H_1$ of each of the edge springs 36. Additionally, as shown in FIG. 11, in a relaxed condition, each of the core springs 62 has a greater out-of-pocket barrel diameter $D_2$ or is wider than the out-of-pocket barrel diameter $D_1$ of each of the edge springs 36.

In one embodiment in which the height of the pocketed spring assembly is eight inches, the out-of-pocket height "$H_1$" of each of the edge springs 36 is approximately 270 millimeters, and the out-of-pocket height "$H_2$" of each of the core springs 62 is approximately 230 millimeters. The in-pocket or compressed height "$H_p$" of the edge springs 36 and core springs 62 is approximately eight inches or 203 millimeters. In this embodiment, each of the core springs 62 has an 80 millimeter barrel diameter in a relaxed or out-of-pocket condition compared to the 77 millimeter barrel diameter of the edge spring 36 in a relaxed or out-of-pocket condition. See FIG. 11.

Figure 4:
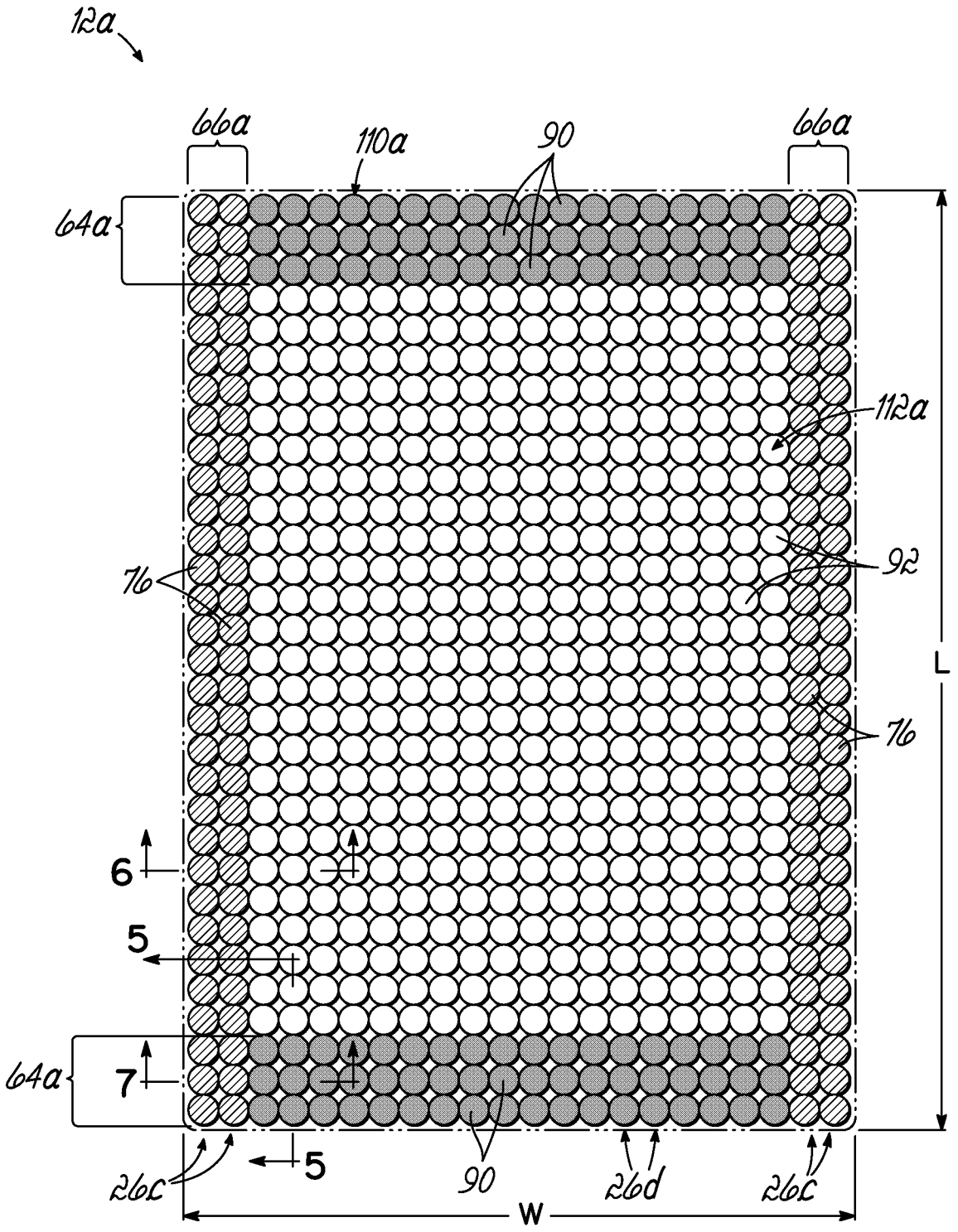
FIG. 4 is a top view, similar to FIG. 2, of an alternative embodiment of pocketed spring assembly.
Figure 5:
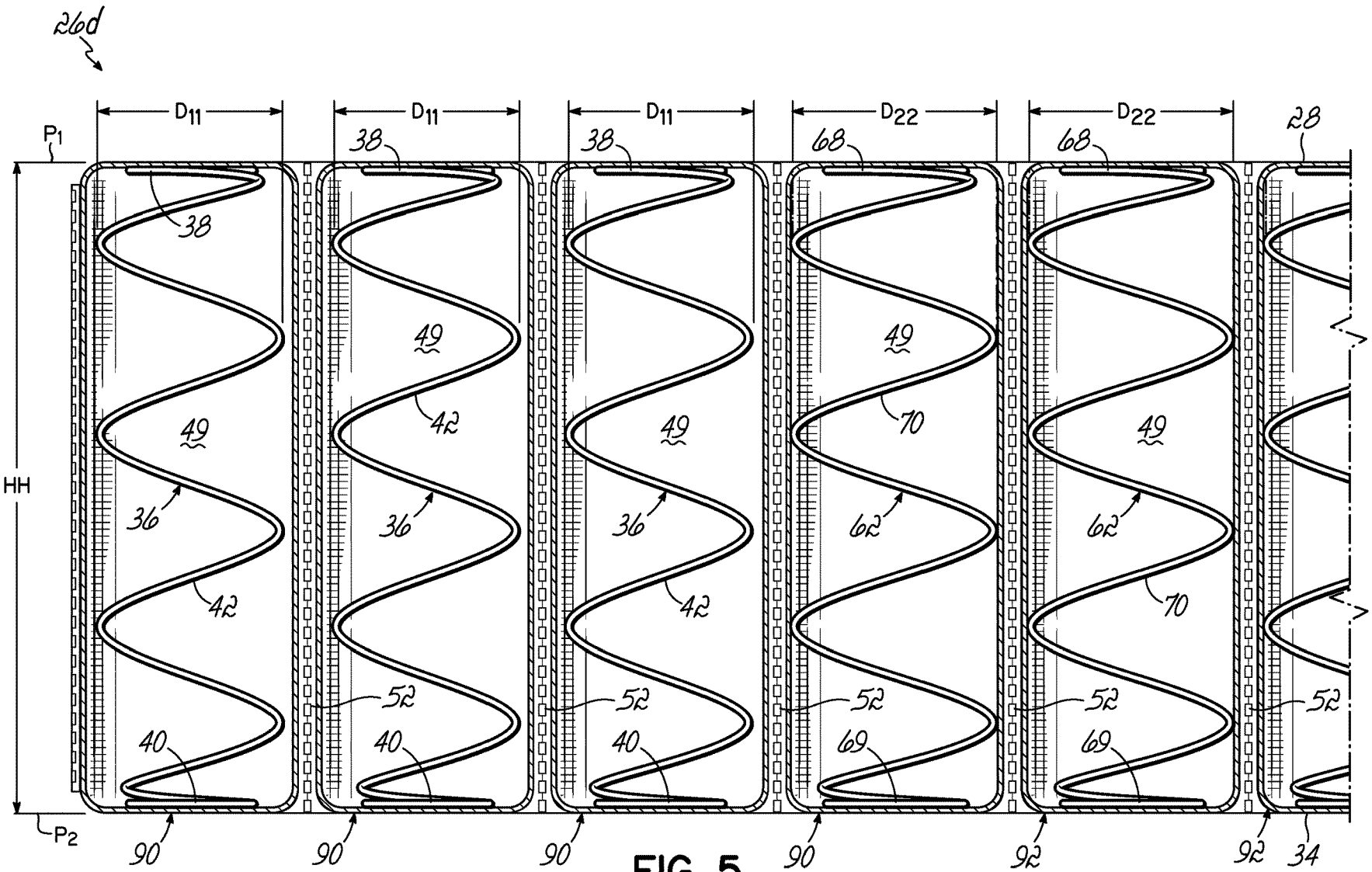
FIG. 5 is a cross-sectional view taken along the line 5-5 of FIG. 4 showing an outer portion of one of the interior strings.
Figure 6:
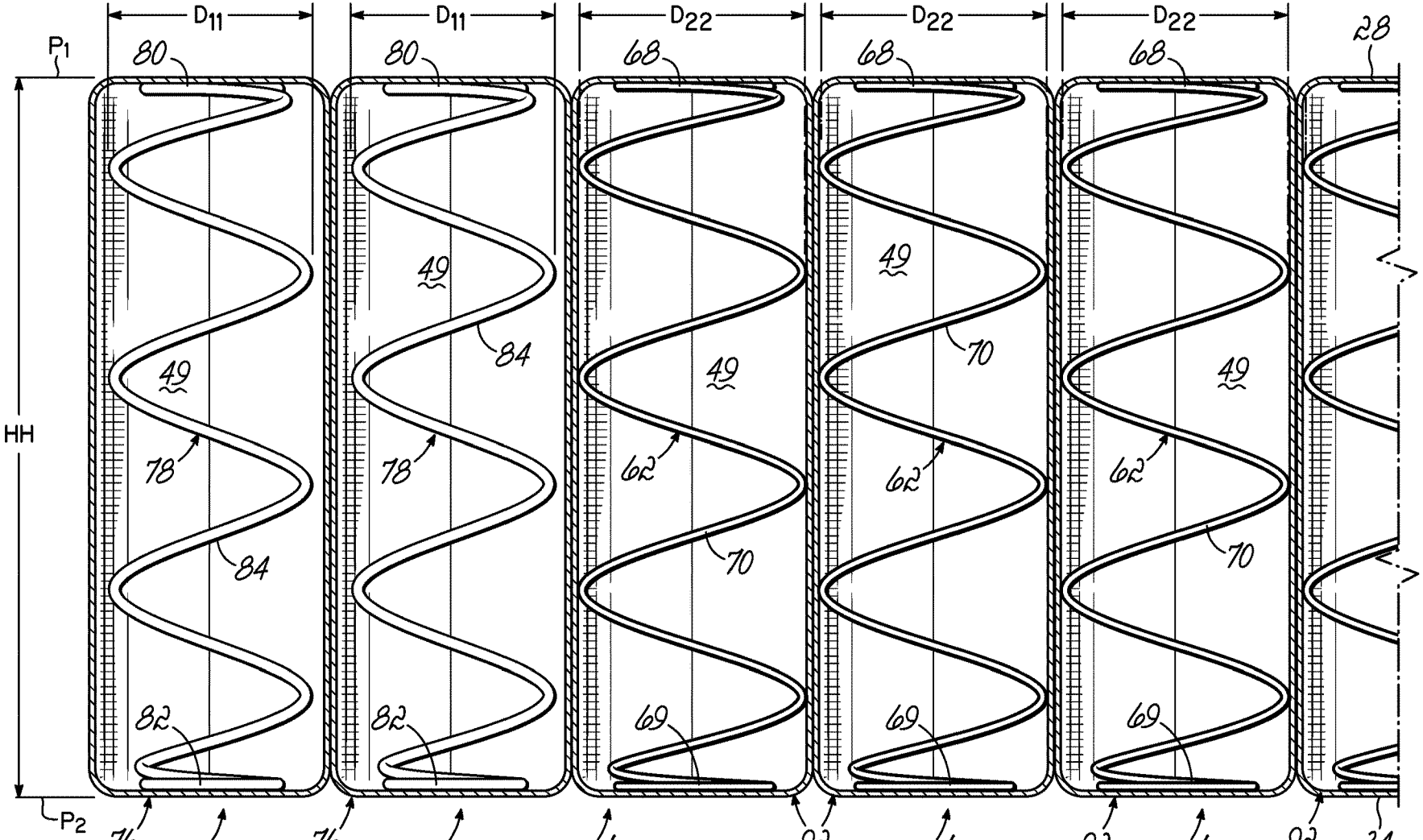
FIG. 6 is a cross-sectional view taken along the line 6-6 of FIG. 4 showing two exterior strings and several interior strings.
Figure 7:
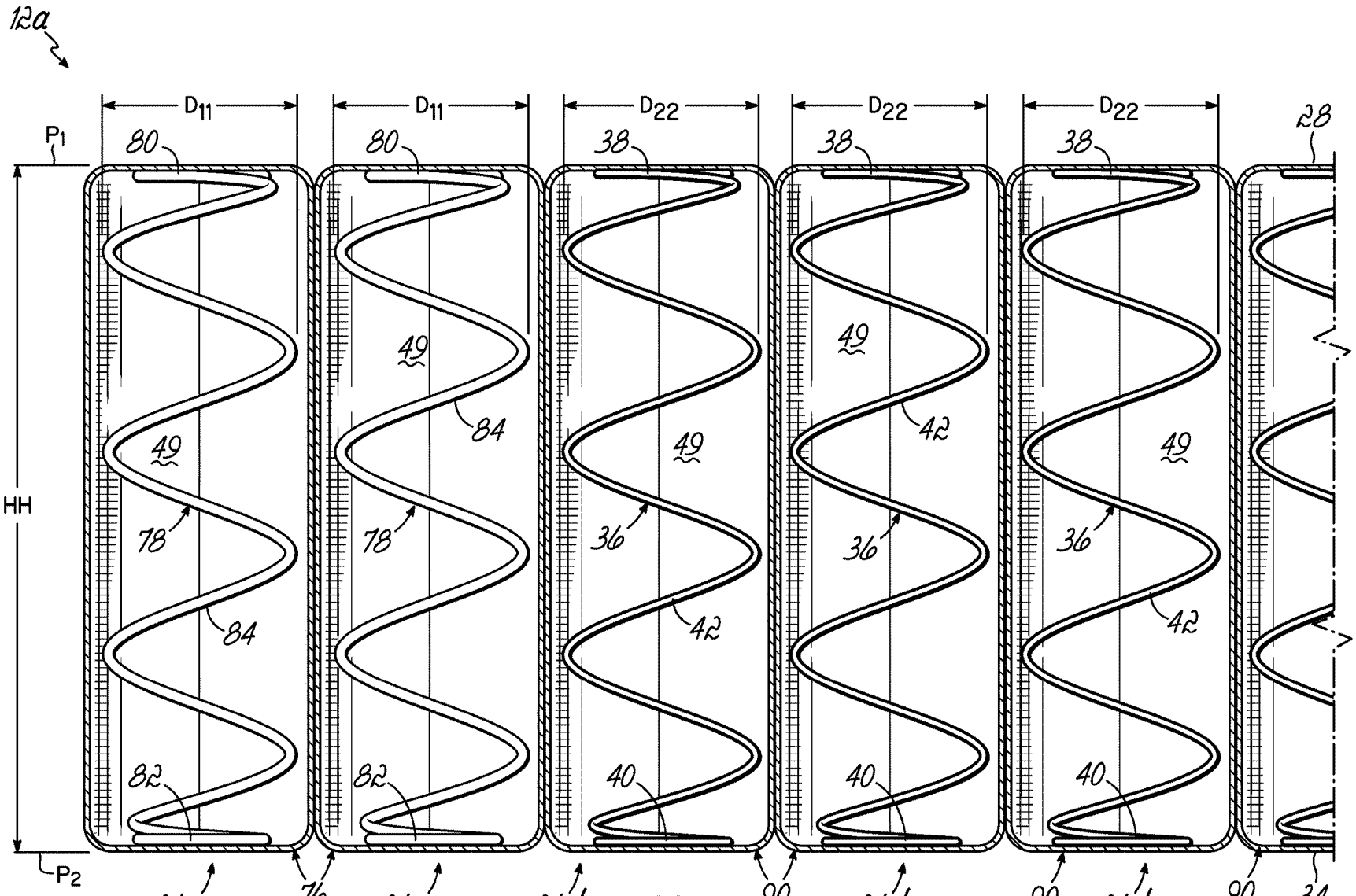
FIG. 7 is a cross-sectional view taken along the line 7-7 of FIG. 4 showing two exterior strings and end portions of several interior strings.

FIGS. 4-7 illustrate a portion of another embodiment of pocketed spring assembly 12*a* which may be incorporated into any of the products shown or described herein. This embodiment of pocketed spring assembly 12*a* comprises two different longitudinally extending strings of springs: exterior strings of springs 26*c* and interior strings of springs 26*d*. As shown in FIGS. 5, 6 and 7, each of the strings 26*c*, 26*d* of pocketed spring assembly 12*a* is the same height "HH". As shown in FIG. 4, pocketed spring assembly 12*a* comprises two exterior strings of springs 26*c* on each side of multiple interior strings of springs 26*d*. Each exterior string of springs 26*c* and each interior string of springs 26*d*, respectively, extends the entire length "L" of the mattress or product in which it is used. Each set of two exterior strings of springs 26*c* comprises a side section 66*a* of pocketed spring assembly 12*a*.

As shown in FIGS. 4, 6 and 7, each exterior string 26*c* comprises a row of interconnected fabric pockets 76. Each of the fabric pockets 76 of exterior string 26*c* contains at least one "heavy edge" coil spring 78 compressed to a height "HH" of the pocket 76 and string 26*c*. FIG. 11 shows one of the heavy edge springs 78 in an out-of-pocket or relaxed condition. The heavy edge spring 78 has a central or longitudinal axis AAA, an upper end turn 80, a lower end turn 82 and a plurality of central convolutions 84 between the end turns 80, 82. The heavy edge spring 78 is barrel-shaped, the diameter of the end turns 80, 82 being smaller than the diameter of the central convolutions 84. At least one of the central convolutions 84 has a barrel diameter $D_1$ greater than the diameters of the other convolutions of the spring. As shown in FIG. 11, the out-of-pocket barrel diameter $D_1$ of the heavy edge spring 78 is approximately identical to the out-of-pocket barrel diameter $D_1$ of the edge spring 36. In one preferred embodiment, this out-of-pocket barrel diameter $D_1$ is 77 millimeters.

As best shown in FIGS. 6, 7 and 11, each barrel-shaped heavy edge spring 78 is symmetrical, including a center or middle portion 86 and two identical end portions 88. Upon being compressed and inserted into one of the pockets 76, the barrel diameter $D_1$ of heavy edge spring 78 shown in FIG. 11 expands to barrel diameter $D_{11}$ shown in FIGS. 6 and 7.

As shown in FIGS. 4, 6 and 7, each pocket 76 of each exterior string 26*c* has a heavy edge spring 78 therein in a compressed condition. As shown in FIGS. 11 and 12B, each of the heavy edge springs 78 has an out-of-pocket height "$H_1$" approximately the same as the out-of-pocket height of the edge springs 36. In one preferred embodiment, this out-of-pocket height "$H_1$" is 270 millimeters. When compressed and inserted into a pocket 76 of an exterior string 26*c*, the height of the heavy edge spring 78 shortens to "$H_{11}$", which in one preferred embodiment, is approximately eight inches or 203.2 millimeters. As best seen in FIG. 11, in a relaxed or out-of-pocket condition, the heavy edge spring 78 is similar to the edge spring 36, having the same barrel diameter and out-of-pocket height and number of turns. However, the heavy edge spring 78 is made of a thicker or heavier gauge wire than edge spring 36. In one embodiment, the heavy edge springs 78 are made of 13.75 gauge wire, and the edge springs 36 are made of 14 gauge wire. These gauges are not intended to be limiting, but merely an example.

As shown in FIGS. 4-7, each interior string 26*d* of pocketed spring assembly 12*a* comprises a row of interconnected fabric pockets 90, 92. Each interior string 26*d*, as well as each exterior string 26*c* of pocketed spring assembly 12*a*, has a height "HH". Three of the fabric pockets 90 at each end of each interior string 26*d* contain at least one edge spring 36. These six pockets 90 (three on each end) are considered outer pockets 90 of the interior string 26*d* for purposes of this document. For purposes of this document, the pockets between the outer pockets 90 are considered inner pockets 92 of each interior string 26*d*. Within each interior string 26*d*, each outer pocket 90 contains at least one edge spring 36, and each inner pocket 92 contains at least one core spring 62.

Although the pocketed spring assembly 12*a* shown in FIGS. 4-7 shows each interior string 26*d* having three outer pockets 90 at each end, each outer pocket 90 containing at least one edge spring 36, each interior string 26*d* may have more or less than three outer pockets 90 at each end, each outer pocket 90 containing at least one edge spring 36.

As shown in FIG. 4, pocketed spring assembly 12*a* has opposite end sections 64*a* made up of pocketed edge springs 36 and pocketed heavy edge springs 78. Pocketed spring assembly 12*a* also has opposite side sections 66*a* made up of pocketed edge springs 36. The end sections 64*a* and side sections 66*a* made up a picture-frame shape of edge support which provides increased stiffness around the perimeter of the pocketed spring assembly 12*a*.

In this embodiment, the pocketed spring assembly 12*a* has a four-sided perimeter section 110*a* surrounding an interior or core section 112*a*. The pocketed springs of the perimeter section 110*a* of pocketed spring assembly 12*a* comprise pocketed edge springs 36 and pocketed heavy edge springs 78. The pocketed springs of the core section 112*a* are pocketed core springs 62. The pocketed spring assembly 12*a* has a uniform height HH. Each side of the perimeter section 110*a* is firmer than the core section 112*a* due to the out-of-pocket characteristics or make-up of the three different springs (edge, heavy edge and core springs) in the two different sections: perimeter section 110*a* and core section 112*a*. See FIG. 4.

Although the pocketed spring assembly 12*a* shown in FIGS. 4-7 shows two exterior strings 26*c* per side section 66*a*, each side section 66*a* may comprise more or less than two exterior strings 26*c* per side section 66*a*. Similarly, although the pocketed spring assembly 12*a* shown in FIGS. 4-7 shows three rows of pockets per end section 64*a*, each end section 64*a* may comprise more or less than three rows of pockets per end section 64*a*.

Figure 12C:
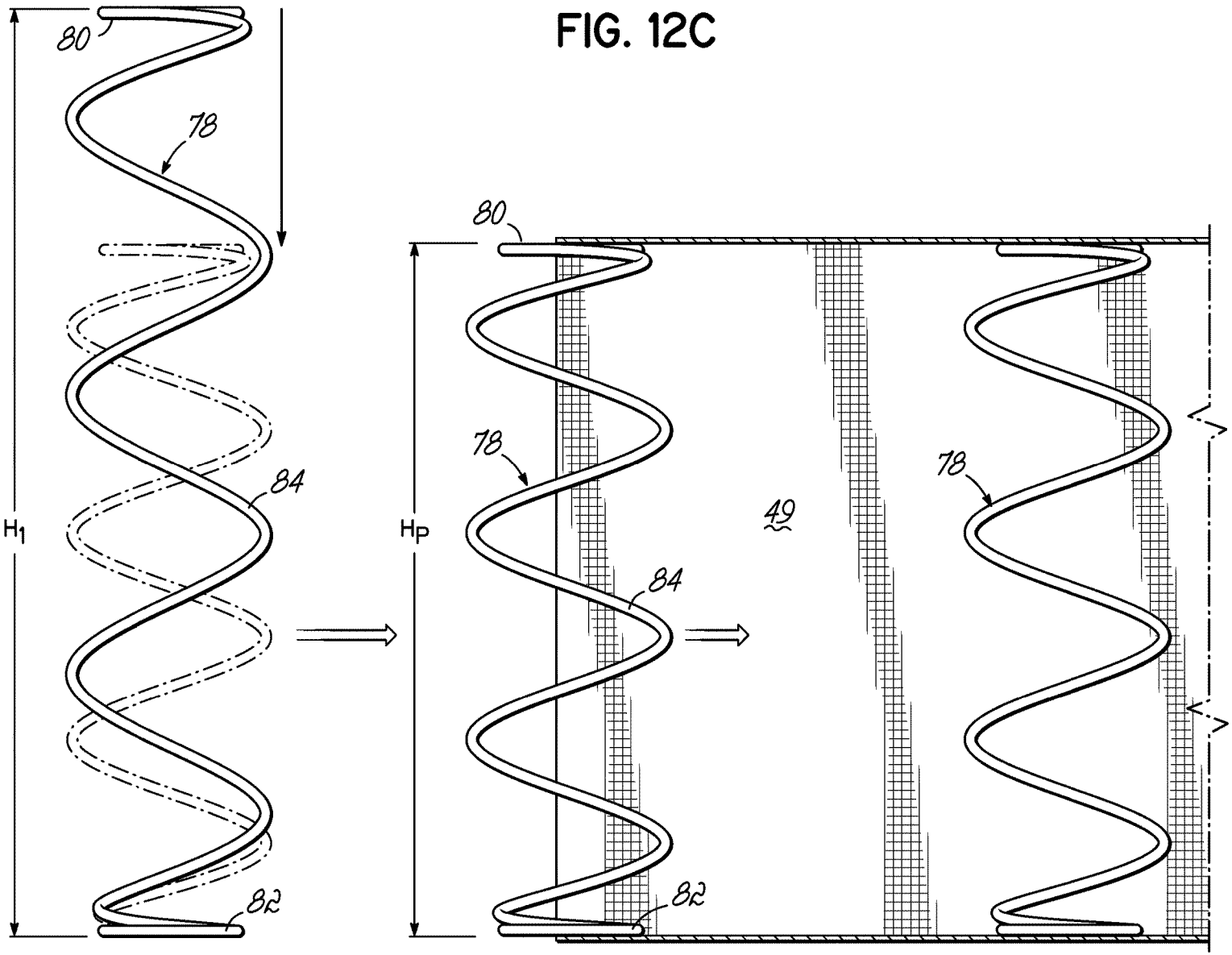
FIG. 12C is a side elevational view of a heavy edge spring being compressed and pocketed.

As shown in FIG. 12C, each of the heavy edge springs 78 has an out-of-pocket height "$H_1$" which, in one preferred embodiment, is 270 millimeters. When compressed and inserted into an exterior pocket 76 of an exterior string 26*c* of pocketed spring assembly 12*a*, the height of the heavy edge spring 78 shortens to "$H_p$" which, in one preferred embodiment, is eight inches or 203.2 millimeters, but may be any desired dimension.

Figure 8:
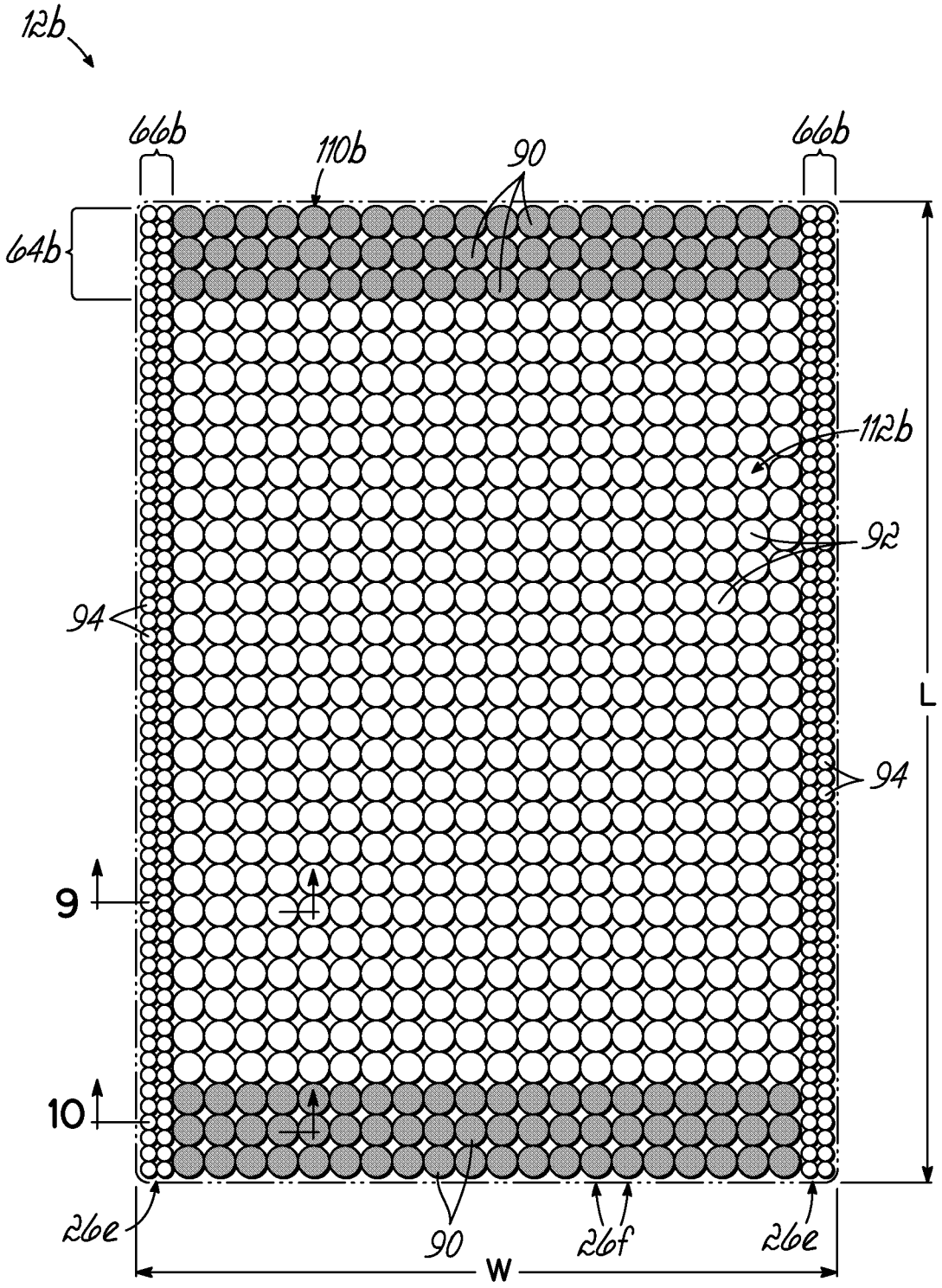
FIG. 8 is a top view, similar to FIG. 2, of an alternative embodiment of pocketed spring assembly.
Figure 9:
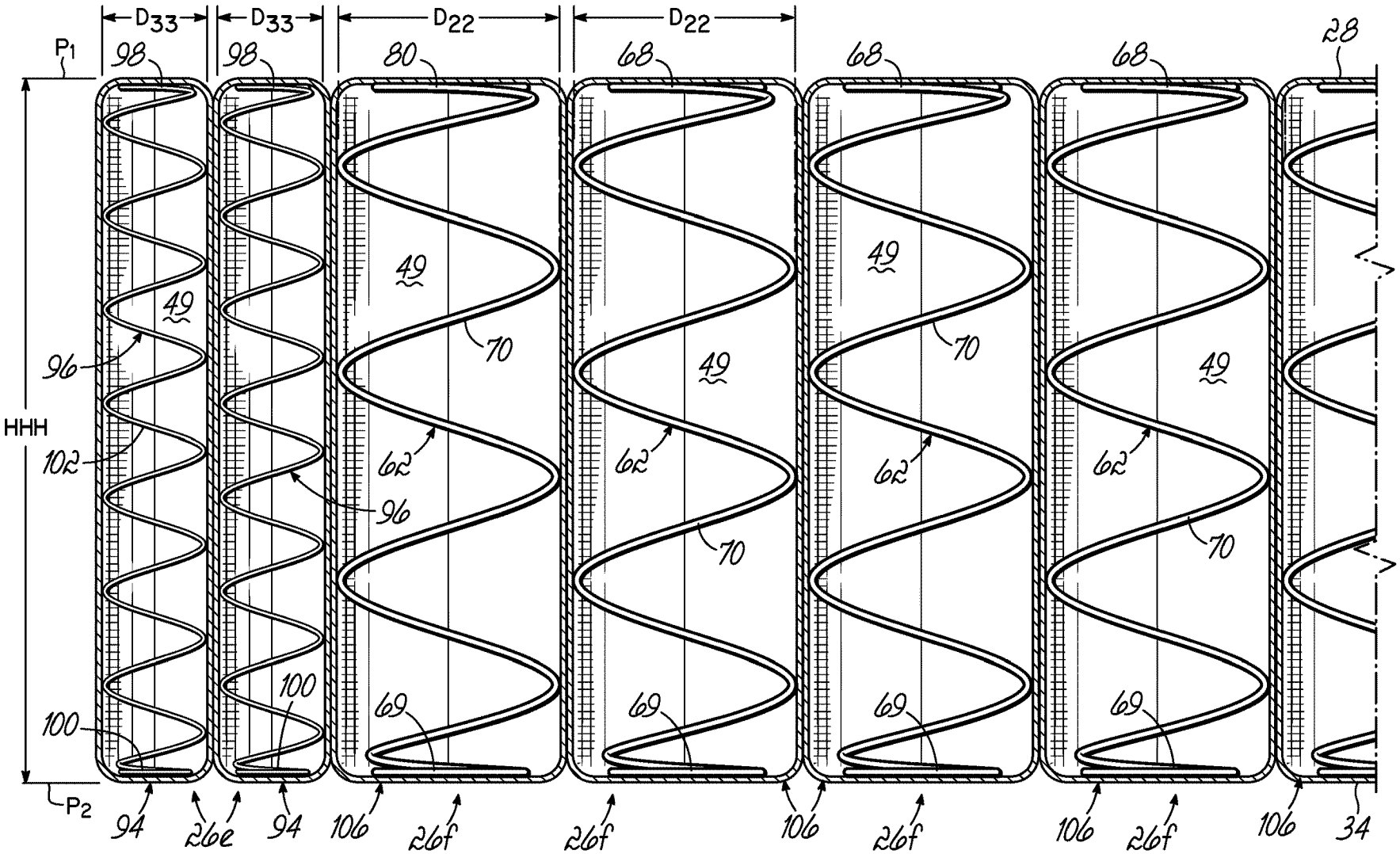
FIG. 9 is a cross-sectional view taken along the line 9-9 of FIG. 8 showing two exterior strings and several interior strings.
Figure 10:
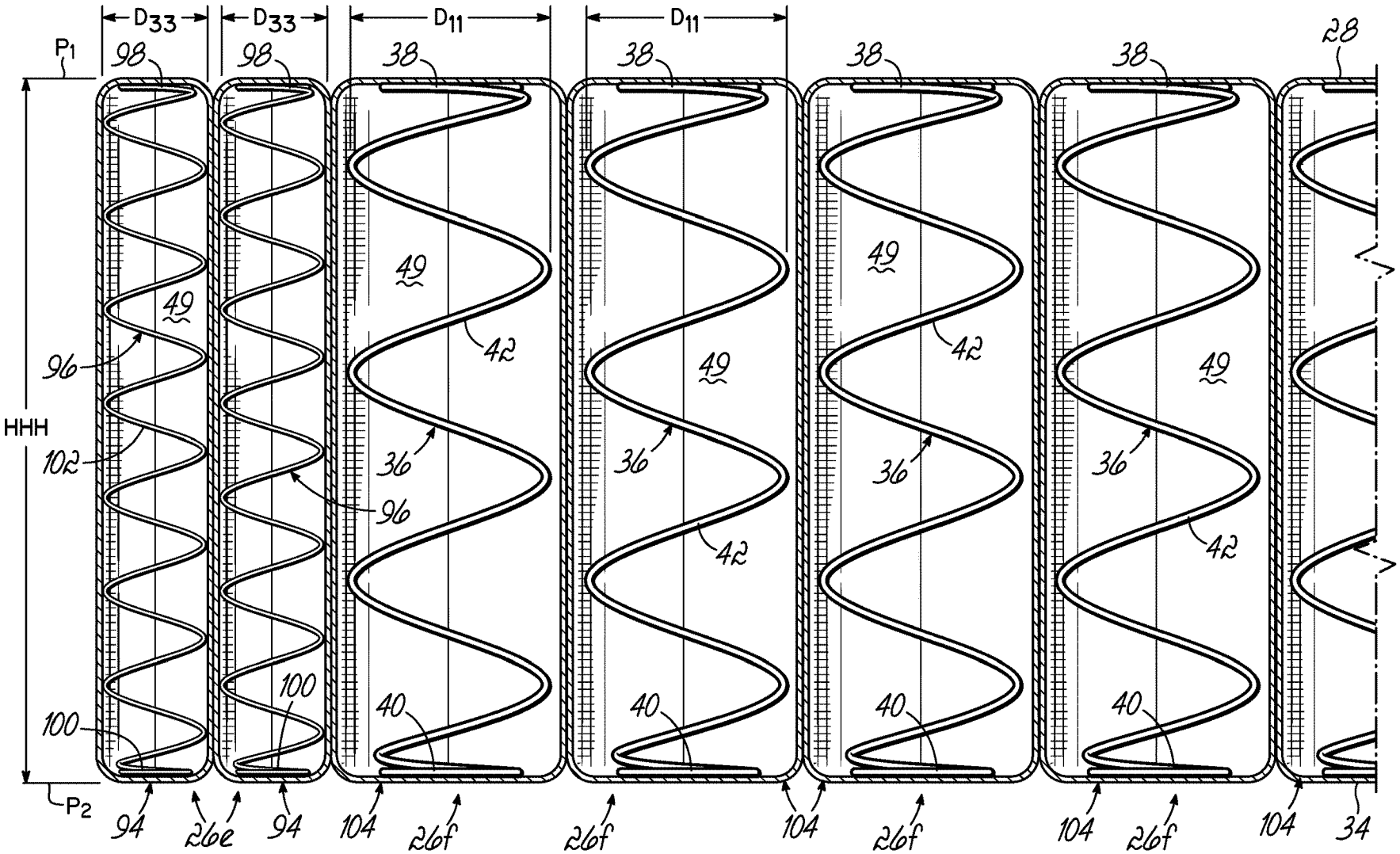
FIG. 10 is a cross-sectional view taken along the line 10-10 of FIG. 8 showing two exterior strings and end portions of several interior strings.

FIGS. 8-10 illustrate a portion of another embodiment of pocketed spring assembly 12*b* which may be incorporated into any of the products shown or described herein. This embodiment of pocketed spring assembly 12*b* comprises two different longitudinally extending strings of springs: interior strings of springs 26*f* and exterior strings of springs 26*e*. As shown in FIGS. 9 and 10, each of the strings 26*e*, 26*f* of pocketed spring assembly 12*b* is the same height "HHH". In one embodiment, the height HHH is the same height, eight inches, as the height HH of pocketed spring assembly 12*a*. As shown in FIG. 8, pocketed spring assembly 12*b* comprises two exterior strings of springs 26*e* on each side of multiple interior strings of springs 26*f*. Each exterior string of springs 26*e* and each interior string of springs 26*f*, respectively, extends the entire length "L" of the mattress or product in which it is used. As shown in FIG. 8, each set of two exterior strings of springs 26*e* comprises a side section 66*b* of pocketed spring assembly 12*b*.

Figure 12D:
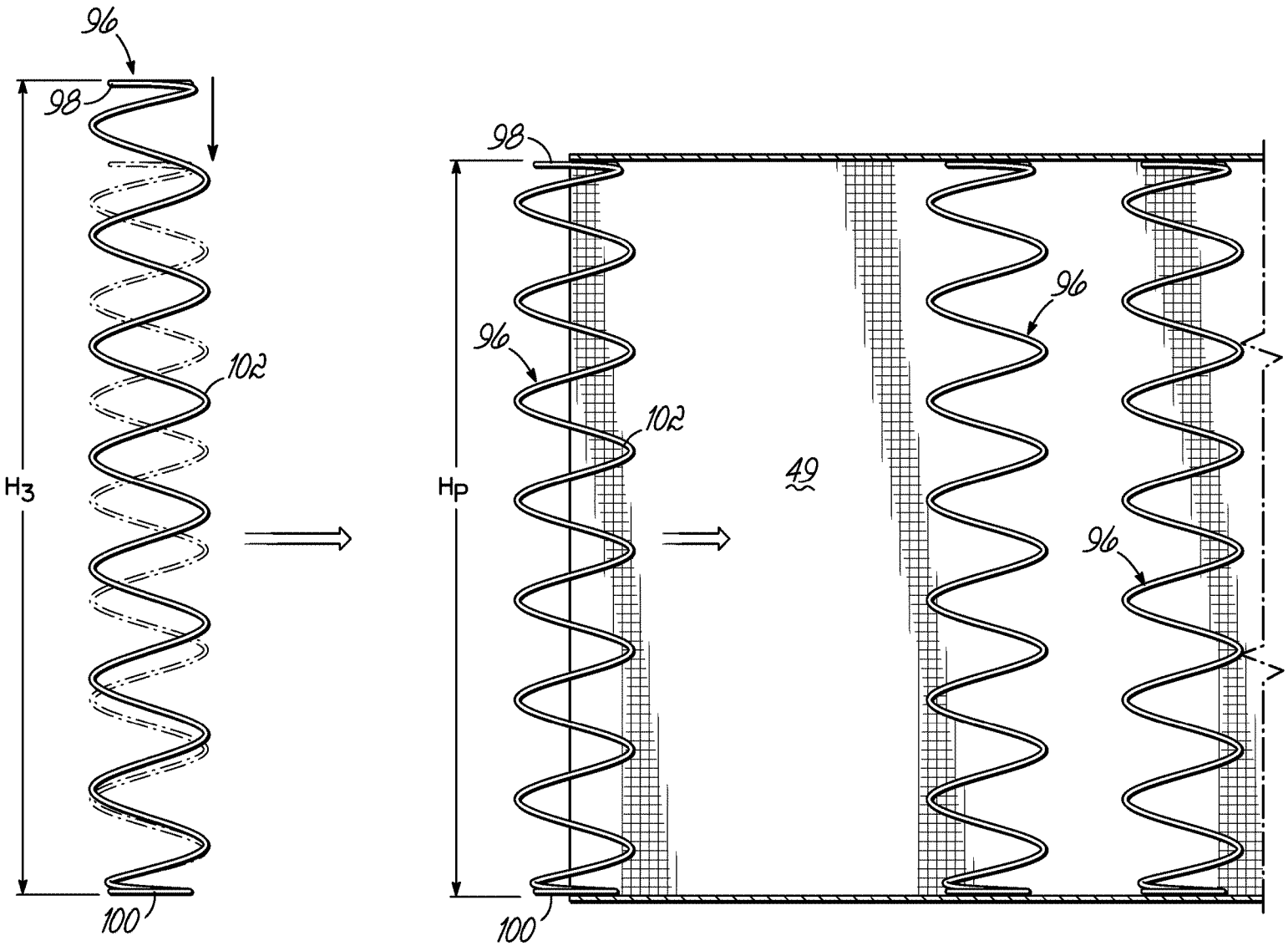
FIG. 12D is a side elevational view of a post spring being compressed and pocketed.

As shown in FIGS. 9 and 10, each exterior string 26*e* comprises a row of interconnected fabric pockets 94. Each of the fabric pockets 94 contains at least one "post" coil spring 96 compressed to a height "HHH" within a pocket 94. The post spring 96 has more convolutions than the edge, heavy edge or core springs of any of the embodiments shown or described herein. As best shown in FIG. 11, each post spring 96 has a central or longitudinal axis AAAA, an upper end turn 98, a lower end turn 100 and a plurality of central convolutions 102 between the end turns. FIGS. 9, 10 and 11 illustrate a barrel-shaped post spring 96 in which the diameter of the end turns 98, 100 is less than the diameter of the central convolutions 102. At least one of the central convolutions 104 has a barrel diameter $D_3$ greater than the diameters of the other convolutions of the post spring 96. As best shown in FIGS. 9, 10 and 11, each barrel-shaped post spring 96 is symmetrical, having a center or middle portion 104 and two identical end portions 106. As shown in FIGS. 11 and 12D, each of the post springs 96 has an out-of-pocket height "$H_3$", less than the out-of-pocket height $H_1$ of the edge springs 36 and heavy edge springs 78. However, the out-of-pocket height $H_3$ of the post springs 96 may be equal to or greater than the out-of-pocket height of either the edge springs 36 or the heavy edge springs 78.

As shown in FIGS. 8, 9 and 10, each pocket 94 of each exterior string 26*e* has a post spring 96 therein in a compressed condition. In one preferred embodiment, the out-of-pocket height "$H_3$" of the post springs is 229 millimeters, while the out-of-pocket height $H_1$ of the edge springs 36 is 270 millimeters. When compressed and inserted into a pocket 94 of an exterior string 26*e*, the height of the post spring 96 shortens to approximately "Hp", which, in one preferred embodiment, is eight inches or 203.2 millimeters.

When compressed and inserted into a pocket 94 of an exterior string 26*e*, the barrel diameter $D_3$ of the post spring 96 expands to $D_{33}$. In one preferred embodiment, the post spring 96 has a barrel diameter of 41 millimeters in a relaxed or out-of-pocket condition.

As best seen in FIG. 11 in a relaxed or out-of-pocket condition, the post spring 96 is smaller and narrower than the edge spring 36, having a smaller barrel diameter and out-of-pocket height. In addition, the post spring 96 is made of a thinner or lesser gauge wire than edge spring 36. In one embodiment, the post springs 96 are made of 16 gauge wire, and the edge springs 36 are made of 14 gauge wire. These gauges are not intended to be limiting, but merely an example.

In any of the embodiments shown and described herein, the dimensions given are merely examples and not intended to be limiting. This includes the dimensions given for the barrel diameter, out-of-pocket height, in-pocket height and number of convolutions of any of the springs.

As shown in FIGS. 8, 9 and 10, each interior string 26*f* of pocketed spring assembly 12*b* comprises a row of interconnected fabric pockets 90, 92. Three of the fabric pockets 104 at each end of the interior string 26*f* contain at least one edge spring 36 compressed to a height "$H_p$" within the pocket. For purposes of this document, these pockets 104 are considered outer pockets of the interior string 26*f*, and the pockets therebetween are considered inner pockets of the interior string 26*f*. Within each interior string 26*f*, each outer pocket 104 contains at least one edge spring 36, and each inner pocket 106 contains at least one core spring 62. As shown in FIG. 8, pocketed spring assembly 12*b* has opposite end sections 64*b* made up of solely pocketed edge springs 36. The end sections 64*b* and side sections 66*b* made up a picture-frame shape of edge support which provides increased stiffness around the perimeter of the pocketed spring assembly 12*b*.

In this embodiment, the pocketed spring assembly 12*b* has a four-sided perimeter section 110*b* surrounding an interior or core section 112*b*. The pocketed springs of the perimeter section 110*b* of pocketed spring assembly 12*b* comprise pocketed post springs 96 and pocketed edge springs 36. The pocketed springs of the core section 112*b* are pocketed core springs 62. The pocketed spring assembly 12*b* has a uniform height HHH. Each side of the perimeter section 110*b* is firmer than the core section 112*b* due to the out-of-pocket characteristics or make-up of the three different springs (edge, post and core springs) in the two different sections: perimeter section 110*b* and core section 112*b*. See FIG. 8.

As shown in FIG. 12D, each of the post springs 96 has an out-of-pocket height "$H_3$" which, in one preferred embodiment, is 226 millimeters. When compressed and inserted into an exterior pocket 94 of an exterior string 26*e* of pocketed spring assembly 12*b*, the height of the post spring 96 shortens to "$H_p$" which, in one preferred embodiment, is eight inches or 203.2 millimeters.

Figure 13:
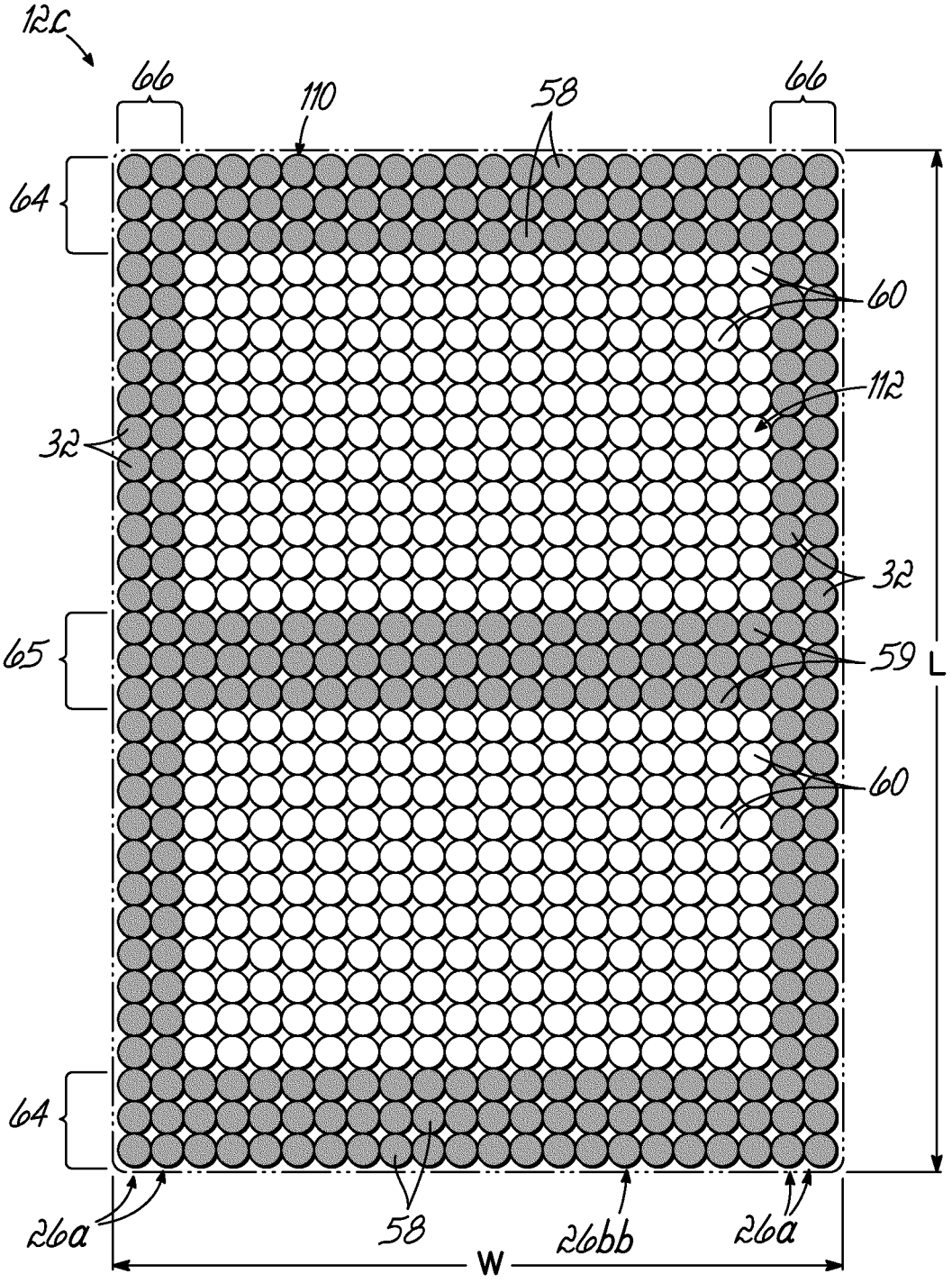
FIG. 13 is a top view, similar to FIG. 2, of an alternative embodiment of pocketed spring assembly.

FIG. 13 illustrates another embodiment of pocketed spring assembly 12*c* similar to pocketed spring assembly 12 shown in FIG. 2. Pocketed spring assembly 12*c* is manufactured from multiple strings 26*a*, 26*b* b of pocketed springs 28 joined together. Each string of pocketed springs 26*a*, 26*b* b extends longitudinally or from head-to-foot along the full length of the assembly 12*c*. The strings 26*a* are identical to those of the pocketed spring assembly 12 shown in FIG. 2 and described above.

As shown in FIG. 13, pocketed spring assembly 12*c* has opposite end sections 64 and a middle section 65 made up of solely pocketed edge springs 36. The end sections 64, side sections 66 and middle section 65 each containing pocketed edge springs 36, make up a picture-frame shape of edge support which provides increased stiffness around the perimeter of the pocketed spring assembly 12 and across the back of a user.

Each of the interior strings 26*bb* of pocketed spring assembly 12*c* is identical and comprises three outer pockets 58 on each end and three middle pockets 59, each containing a pocketed edge spring 36. Between the outer pockets 58 and middle pockets 59 are inner pockets 60, each inner pocket 60 containing at least one core spring 62. Instead of one core section 112, like in pocketed spring assembly 12, pocketed spring assembly 12*c* has two core sections 112 on opposite sides of the middle section 65. Although FIG. 13 illustrates one middle section 65 those skilled in the art will appreciate multiple sections may be incorporated into a pocketed spring assembly at any desired locations by modifying the composition of the interior strings of the pocketed spring assembly.

In each of the embodiments illustrated and described herein, each side section of a pocketed spring assembly is illustrated as comprising two columns. Similarly, each end section of each pocketed spring assembly is illustrated as comprising three rows. However, each end section may be any number of rows or columns of pocketed springs, preferably one to five. Each side section may be any number of rows or columns of pocketed springs, preferable one to five.

Although the pocketed springs have been described herein as barrel-shaped springs, it is within the scope of the inventions described herein that the springs be cylindrical, an hour-glass shape of some other shape. Likewise, the pocketed springs need not be symmetrical, but may be any desired known configuration.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A bedding or seating product comprising:

a pocketed spring assembly having a uniform height and comprising a plurality of parallel strings of springs including exterior strings and interior strings, each of said strings being joined to at least one adjacent string and being approximately the same height, each of said strings comprising first and second opposed plies of fabric and a plurality of pockets formed along a length of said string by transverse seams joining said first and second plies, and at least one spring positioned in each of said pockets;

each of said springs having upper and lower end turns and a plurality of central convolutions between said end turns, at least one of the central convolutions having a barrel diameter greater than the diameters of the other convolutions of the spring;

the pocketed spring assembly having a perimeter section surrounding an interior section, the perimeter section comprising two side sections and two end sections, each side of the perimeter section being firmer than the core section due to the out-of-pocket characteristics of the springs within the sections, each of the springs of the interior section having an out-of-pocket barrel diameter greater than the out-of-pocket barrel diameter of the springs of the end and side sections and each of the springs of the interior section having a shorter out-of-pocket height than the springs of the end and side sections, wherein each of said pockets of each of the exterior strings contains an edge spring, each of the edge springs having a first out-of-pocket barrel diameter and a first out-of-pocket height;

each of the interior strings having two different springs, core and edge springs along its length and comprising outer pockets and inner pockets between the outer pockets, each of the inner pockets containing a core spring and each of the outer pockets containing an edge spring, each of the core springs having a second out-of-pocket barrel diameter and a second out-of-pocket height, the first out-of-pocket barrel diameter of the edge springs being less than the second out-of-pocket barrel diameter of the core springs and the first out-of-pocket height of the edge springs being greater than the second out-of-pocket height of the core springs, such that due to the core and edge springs having approximately the same in-pocket height, each of the interior strings having pocketed springs of different firmness, providing the pocketed spring assembly with four sides of edge support, the pocketed edge springs surrounding the pocketed core springs;

cushioning materials; and a covering encasing said pocketed spring assembly and cushioning materials.

2. A bedding or seating product comprising:

a pocketed spring assembly having a uniform height and comprising a plurality of parallel strings of springs including exterior strings and interior strings, each of said strings being joined to at least one adjacent string and being approximately the same height, each of said strings comprising first and second opposed plies of fabric and a plurality of pockets formed along a length of said string by transverse seams joining said first and second plies, and at least one spring positioned in each of said pockets;

each of said springs having upper and lower end turns and a plurality of central convolutions between said end turns, at least one of the central convolutions having a barrel diameter greater than the diameters of the other convolutions of the spring;

the pocketed spring assembly having a perimeter section surrounding an interior section, the perimeter section comprising two side sections and two end sections, each side of the perimeter section being firmer than the core section due to the out-of-pocket characteristics of the springs within the sections, each of the springs of the interior section having an out-of-pocket barrel diameter greater than the out-of-pocket barrel diameter of the springs of the end and side sections and each of the springs of the interior section having a shorter out-of-pocket height than the springs of the end and side sections, wherein each of said pockets of each of the exterior strings contains an edge spring, each of the edge springs having a first out-of-pocket barrel diameter and a first out-of-pocket height;

each of the interior strings having two different springs, core and edge springs along its length and comprising outer pockets and inner pockets between the outer pockets, each of the inner pockets containing a core spring and each of the outer pockets containing an edge spring, each of the core springs having a second out-of-pocket barrel diameter and a second out-of-pocket height, the first out-of-pocket barrel diameter of the edge springs being less than the second out-of-pocket barrel diameter of the core springs and the first out-of-pocket height of the edge springs being greater than the second out-of-pocket height of the core springs, such that due to the core and edge springs having approximately the same in-pocket height, each of the interior strings having pocketed springs of different firmness, providing the pocketed spring assembly has with four sides of edge support, the pocketed edge springs surrounding the pocketed core springs.

3. The product of claim 2 wherein each of the interior strings has two to ten edge springs.

4. The product of claim 2 wherein said strings extend longitudinally.

5. The product of claim 2 wherein said strings extend transversely.

6. The product of claim 2 wherein all of the springs within a string are made of the same gauge wire.

7. The product of claim 2 wherein each of the edge and core springs is made of the same gauge wire.

8. The product of claim 2 wherein one to five exterior strings are located on each side of the interior strings of the pocketed spring assembly.

9. The product of claim 2 further comprising at least one scrim sheet.

10. A pocketed spring assembly for a bedding or seating product, said pocketed spring assembly comprising:

interior and exterior parallel strings of springs of the same height, each of the strings being joined to at least one adjacent string, each of the strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams;

each of said springs having upper and lower end turns and a plurality of central convolutions between said end turns, the spring having two end portions and a middle portion between the end portions having a barrel diameter, the convolutions of the middle portion being greater in diameter than the convolutions of the end portions of the spring;

the pocketed spring assembly having a perimeter section surrounding an interior section, the perimeter section comprising two side sections and two end sections, each side of the perimeter section being firmer than the core section due to the out-of-pocket characteristics of the springs within the sections, each of the springs of the interior section having an out-of-pocket barrel diameter greater than the out-of-pocket barrel diameter of the springs of the end and side sections and each of the springs of the interior section having a shorter out-of-pocket height than the springs of the end and side sections, wherein each of the pockets of each of the exterior strings contains a heavy edge spring and each interior string has two different springs along its length including a plurality of core springs contained in inner pockets and edge springs in outer pockets of the interior string, the core springs having a greater out-of-pocket barrel diameter and a smaller out-of-pocket height than the edge and heavy edge springs, such that the pocketed spring assembly has four sides of edge support, said edge and heavy edge springs surrounding the core springs.

11. The spring assembly of claim 10 wherein all of the springs within a string are made of the same gauge wire.

12. The spring assembly of claim 10 wherein each of the heavy edge springs is made of a thicker wire than each of the core and edge springs.

13. The spring assembly of claim 10 wherein the heavy edge and edge springs has the same out-of-pocket height and same barrel diameter.

14. A pocketed spring assembly for a bedding or seating product, said pocketed spring assembly comprising:

interior and exterior parallel strings of springs of the same height, each of the strings being joined to at least one adjacent string, each of the strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams;

each of said springs having upper and lower end turns and a plurality of central convolutions between said end turns, the spring having two end portions and a middle portion between the end portions having a barrel diameter, the convolutions of the middle portion being greater in diameter than the convolutions of the end portions of the spring;

the pocketed spring assembly having a perimeter section surrounding an interior section, the perimeter section comprising two side sections and two end sections, each side of the perimeter section being firmer than the core section due to the out-of-pocket characteristics of the springs within the sections, each of the springs of the interior section having an out-of-pocket barrel diameter greater than the out-of-pocket barrel diameter of the springs of the end and side sections and each of the springs of the interior section having a shorter out-of-pocket height than the springs of the end and side sections, wherein each of the pockets of each of the exterior strings contains a post spring and each interior string has two different springs along its length including a plurality of core springs contained in inner pockets and edge springs in outer pockets of the interior string, the core springs having an out-of-pocket barrel diameter greater than the edge springs, the edge springs having a greater out-of-pocket barrel diameter than the post springs and wherein the post springs having more convolutions than the core springs and edge springs.

15. The spring assembly of claim 14 wherein each of the edge springs has a greater out-of-pocket height than each of the core springs.

16. The spring assembly of claim 14 wherein each of the core springs has a greater out-of-pocket height than each of the post springs.

17. The spring assembly of claim 14 wherein each of the post springs has a greater out-of-pocket height than each of the core springs.

18. The spring assembly of claim 14 wherein each of the post springs is made of a thinner wire than each of the core and edge springs.

19. The spring assembly of claim 14 wherein each of the post springs is made of a thicker wire than each of the core and edge springs.

20. The spring assembly of claim 14 wherein all of the springs within a string are made of the same gauge wire.

21. The spring assembly of claim 14 further comprising at least one scrim sheet.

22. A pocketed spring assembly for a bedding or seating product, said pocketed spring assembly comprising:

interior and exterior parallel strings of springs, each of the exterior strings having the same spring along its length and each of the interior strings having two different springs along its length, each of the strings being joined to at least one adjacent string, each of the strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams;

each of said springs having upper and lower end turns and a plurality of central convolutions between said end turns, the largest diameter of the central convolutions being the spring's barrel diameter, all of the springs within a string being made of the same gauge wire;

the pocketed spring assembly having a uniform height and a perimeter section surrounding an interior section, the perimeter section comprising two side sections and two end sections, each side of the perimeter section being firmer than the core section due to the out-of-pocket characteristics of the springs within the sections, each of the springs of the interior section having an out-of-pocket barrel diameter greater than the out-of-pocket barrel diameter of the springs of the end and side sections and each of the springs of the interior section having a shorter out-of-pocket height than the springs of the end and side sections, wherein each of the pockets of each of the exterior strings contains a post spring and each pocket of each interior string contains one of an edge spring and a core spring, the edge springs being in pockets outside the pockets containing the core springs to create edge support for the pocketed spring assembly, each of the core springs having a barrel diameter greater than the barrel diameter of the edge springs and a shorter out-of-pocket height than the edge springs, both the core and edge springs having fewer convolutions than the post springs.

23. The spring assembly of claim 22 wherein each of the core and edge springs has a greater out-of-pocket height than each of the post springs.

24. The spring assembly of claim 22 wherein each of the post springs has a greater out-of-pocket height than each of the core and edge springs.

25. The spring assembly of claim 22 wherein the barrel diameter of each of the post springs is less than the barrel diameter of each of the core and edge springs.

26. The spring assembly of claim 22 wherein each of the post springs is made of a thinner wire than each of the core and edge springs.

27. The spring assembly of claim 22 wherein each of the post springs is made of a thicker wire than each of the core and edge springs.

28. The spring assembly of claim 22 further comprising at least one scrim sheet.

29. The spring assembly of claim 28 wherein each of the springs within each side section is made of a thicker wire than the springs within the interior section.

30. The spring assembly of claim 28 wherein each of the springs within the side and end sections are identical.

31. A pocketed spring assembly for a bedding or seating product, said pocketed spring assembly comprising:

interior and exterior parallel strings of springs of the same pocketed height, each of the strings being joined to at least one adjacent string, each of the strings comprising a plurality of interconnected pockets, each of the pockets containing at least one spring encased in fabric, the fabric being joined to itself along a longitudinal seam and having first and second opposed plies of fabric on opposite sides of the springs, the fabric of said first and second plies being joined by transverse seams, each of the pockets of the exterior strings containing the same springs, outer pockets of the interior strings containing springs different than inner pockets between the outer pockets of the interior strings;

each of said springs having upper and lower end turns and a plurality of central convolutions between said end turns, the largest diameter of the central convolutions being the spring's barrel diameter;

wherein the pocketed spring assembly has a perimeter section surrounding an interior section, the perimeter section comprising two side sections and two end sections, each side of the perimeter section being firmer than the core section due to the out-of-pocket characteristics of the springs within the sections, each of the springs of the interior section having an out-of-pocket barrel diameter greater than the out-of-pocket barrel diameter of the springs of the end and side sections and each of the springs of the interior section having a shorter out-of-pocket height than the springs of the end and side sections.

32. The spring assembly of claim 31 wherein each of the end sections has two different springs of different gauge wire.

* * * * *